US010607551B2

(12) United States Patent
Dai et al.

(10) Patent No.: US 10,607,551 B2
(45) Date of Patent: Mar. 31, 2020

(54) TEMPERATURE-COMPENSATED LED-BACKLIT LIQUID CRYSTAL DISPLAYS

(71) Applicant: Dolby Laboratories Licensing Corporation, San Francisco, CA (US)

(72) Inventors: Qiqin Dai, Chicago, IL (US); Jon S. McElvain, Manhattan Beach, CA (US)

(73) Assignee: Dolby Laboratories Licesing Corporation, San Francisco, CA (US)

( * ) Notice: Subject to any disclaimer, the term of this patent is extended or adjusted under 35 U.S.C. 154(b) by 94 days.

(21) Appl. No.: 15/926,777

(22) Filed: Mar. 20, 2018

(65) Prior Publication Data

US 2018/0277047 A1 Sep. 27, 2018

Related U.S. Application Data

(60) Provisional application No. 62/474,240, filed on Mar. 21, 2017.

(30) Foreign Application Priority Data

Mar. 21, 2017 (EP) ..... 17161997

(51) Int. Cl.
*G09G 3/34* (2006.01)
*G09G 3/36* (2006.01)

(52) U.S. Cl.
CPC ..... *G09G 3/3413* (2013.01); *G09G 3/3426* (2013.01); *G09G 3/36* (2013.01);
(Continued)

(58) Field of Classification Search
CPC ..... G09G 3/3413; G09G 3/3426; G09G 3/36; G09G 2320/0233; G09G 2320/0238;
(Continued)

(56) References Cited

U.S. PATENT DOCUMENTS 8,558,782 B2 10/2013 You
8,687,026 B2 4/2014 Wurzel
(Continued)

FOREIGN PATENT DOCUMENTS

WO 2016/028994 2/2016

OTHER PUBLICATIONS

Lee, Tae-Wook, et al "An Optical Feedback System for Local Dimming Backlight with RGB LEDs" IEEE Transactions on Consumer Electronics, vol. 55, No. 4, Nov. 2009, pp. 2178-2183.
(Continued)

*Primary Examiner* — Robert J Michaud

(57) ABSTRACT

A display system with temperature compensation includes (a) a backlight unit containing a light emitting diode (LED) array, (b) a liquid crystal display (LCD) containing a plurality of pixels for spatially modulating, according to respective LCD drive values of the pixels, transmission of light generated by the LED array, (c) a plurality of temperature probes mounted to the backlight unit for measuring a respective plurality of temperatures at the LED array, (d) a light-field simulator for simulating, at least in part based upon the temperatures, a light field at the LCD as generated by the LED array, and (e) an LCD drive solver for processing a target image and the light field simulated by the light-field simulator, to determine the LCD drive values required to display the target image as compensated for temperatures of the LED array.

12 Claims, 13 Drawing Sheets

(52) U.S. Cl.
CPC ..... *G09G 2320/0233* (2013.01); *G09G 2320/0238* (2013.01); *G09G 2320/0242* (2013.01); *G09G 2320/041* (2013.01); *G09G 2320/0646* (2013.01); *G09G 2320/0693* (2013.01); *G09G 2360/16* (2013.01)

(58) Field of Classification Search
CPC ..... G09G 2320/0242; G09G 2320/041; G09G 2320/0646; G09G 2320/0693; G09G 2360/16
See application file for complete search history.

(56) References Cited

U.S. PATENT DOCUMENTS

| | | | | |
|---|---|---|---|---|
| 8,711,081 | B2 | 4/2014 | Yang | |
| 8,803,928 | B2 | 8/2014 | Nagashima | |
| 8,937,587 | B2 | 1/2015 | Nakajima | |
| 9,082,354 | B2 | 7/2015 | Fujinaka | |
| 9,275,607 | B2 | 3/2016 | Albrecht | |
| 2008/0180414 | A1 | 7/2008 | Fung | |
| 2009/0033612 | A1 | 2/2009 | Roberts | |
| 2009/0322800 | A1* | 12/2009 | Atkins | G09G 3/3413 345/690 |
| 2010/0244701 | A1* | 9/2010 | Chen | G02F 1/133603 315/117 |
| 2011/0163691 | A1 | 7/2011 | Dunn | |
| 2012/0075362 | A1 | 3/2012 | Ichioka | |
| 2013/0016306 | A1 | 1/2013 | Ohno | |
| 2013/0155091 | A1* | 6/2013 | Dai | G09G 3/3648 345/589 |
| 2013/0249932 | A1 | 9/2013 | Siotis | |
| 2015/0221258 | A1 | 8/2015 | Xu | |
| 2015/0287368 | A1 | 10/2015 | Ninan | |
| 2018/0286297 | A1* | 10/2018 | Ong | G09G 3/2003 |

OTHER PUBLICATIONS

Kim,Sung Ki "Analysis on Thermal Management Schemes of LED Backlight Units for Liquid Crystal Displays" IEEE Transactions on Components, Packaging and Manufacturing Technology, vol. 2, No. 11, Nov. 2012, pp. 1838-1846.

* cited by examiner

TEMPERATURE-COMPENSATED LED-BACKLIT LIQUID CRYSTAL DISPLAYS

CROSS-REFERENCE TO RELATED APPLICATION

This application claims the benefit of priority from U.S. Provisional Patent Application No. 62/474,240, filed on Mar. 21, 2017 and European Patent Application No. 17161997.6 filed Mar. 21, 2017, which are hereby incorporated by reference in their entirety.

TECHNICAL FIELD

The present application relates to light emitting diode (LED) backlit liquid crystal displays.

BACKGROUND

Liquid crystal displays are used in a variety of applications including television sets, computer monitors, and smartphones. A liquid crystal display (LCD) includes an array of liquid crystal pixels, each having adjustable transmission. In color LCDs, each pixel includes sub-pixels equipped with color filters, respectively, such that light transmission through each sub-pixel is limited to the transmission band of the respective color filter. Most often, each pixel has three color filters configured to transmit red, green, and blue light, respectively, so as to provide realistic color imagery across the visible spectrum. The LCD is illuminated by a light source emitting essentially white light, or by a light source emitting light in several different bands within the visible spectrum, for example red, green, and blue light. However, LED-based illumination has gained popularity for several reasons, including reliability, low power consumption, low heat output, and wide color gamut (for color LCDs).

In one class of LED-backlit LCDs, an array of LEDs is placed behind the LCD, such that each LED illuminates only a local area of the LCD. Even though the light output from nearby LEDs may have some overlap on the LCD, this type of LED-backlit LCD facilitates a dual modulation scheme, in which the display image is achieved not only through adjusting the transmission of the LCD pixels but also through adjusting the light output of individual LEDs. For example, the light output of LEDs aimed at areas of the LCD displaying a dark portion of an image may be decreased. Such dual-modulation LED-backlit LCDs enables improved dynamic range and improved contrast, as well as reduced power output.

The light output of an LED is somewhat temperature sensitive. Generally, the output power decreases with temperature, and the LED temperature increases when the LED is driven harder to increase its power output. The temperature sensitivity may lead to distorted brightness and/or color representation in images displayed on an LED-backlit LCD as the temperature of the LEDs change during operation. This undesirable effect is of particular significance for dual-modulation LED-backlit LCDs, since the local temperature at any given LED changes as the drive value of the LED (or nearby LEDs) is changed.

SUMMARY

In an embodiment, a display system with temperature compensation, includes a backlight unit, containing a light emitting diode (LED) array, and a liquid crystal display (LCD) containing a plurality of pixels for spatially modulating, according to respective LCD drive values of the pixels, transmission of light generated by the LED array. The display system also includes a plurality of temperature probes mounted to the backlight unit for measuring a respective plurality of temperatures at the LED array. In additional, the display system includes a light-field simulator and an LCD drive solver. The light-field simulator is configured to simulate, at least in part based upon the temperatures, a light field at the LCD as generated by the LED array. The LCD drive solver is configured to process a target image and the light field simulated by the light-field simulator to determine the LCD drive values required to display the target image as compensated for temperatures of the LED array.

In an embodiment, a method for temperature compensation of a light-emitting diode backlit liquid crystal display system includes the steps of receiving (a) a target image and (b) a plurality of temperatures measured at different respective spatial locations of a backlight unit, wherein the backlit unit including an LED array configured to back-illuminate an LCD. The method also includes the steps of (c) simulating, at least partly based upon the temperatures, a light field at the LCD as generated by the LED array, and (d) processing the target image and the light field generated in the step of simulating to determine LCD drive values of pixels of the LCD required to display the target image as compensated for temperatures of the LED array. The method further includes a step of sending the LCD drive values to an LCD controller configured to control the pixels.

In an embodiment, a software product includes instructions, stored on non-transitory computer-readable media, wherein the instructions, when executed by a computer, perform steps for processing temperature measurements of a light-emitting diode array back-illuminating a liquid crystal display, to determine LCD drive values for pixels of the LCD required to display a temperature-compensated image. The instructions include (a) simulation instructions for simulating, at least partly based upon the temperature measurements, a light field generated at the LCD by the LED array, (b) target image processing instructions for processing a target image and the light field generated by said simulating, to determine the LCD drive values required to display the target image as compensated for temperatures of the LED array, and (c) LCD drive value instructions for sending the drive values to an LCD controller configured to control the pixels.

DESCRIPTION OF EXAMPLE EMBODIMENTS

Figure 1:
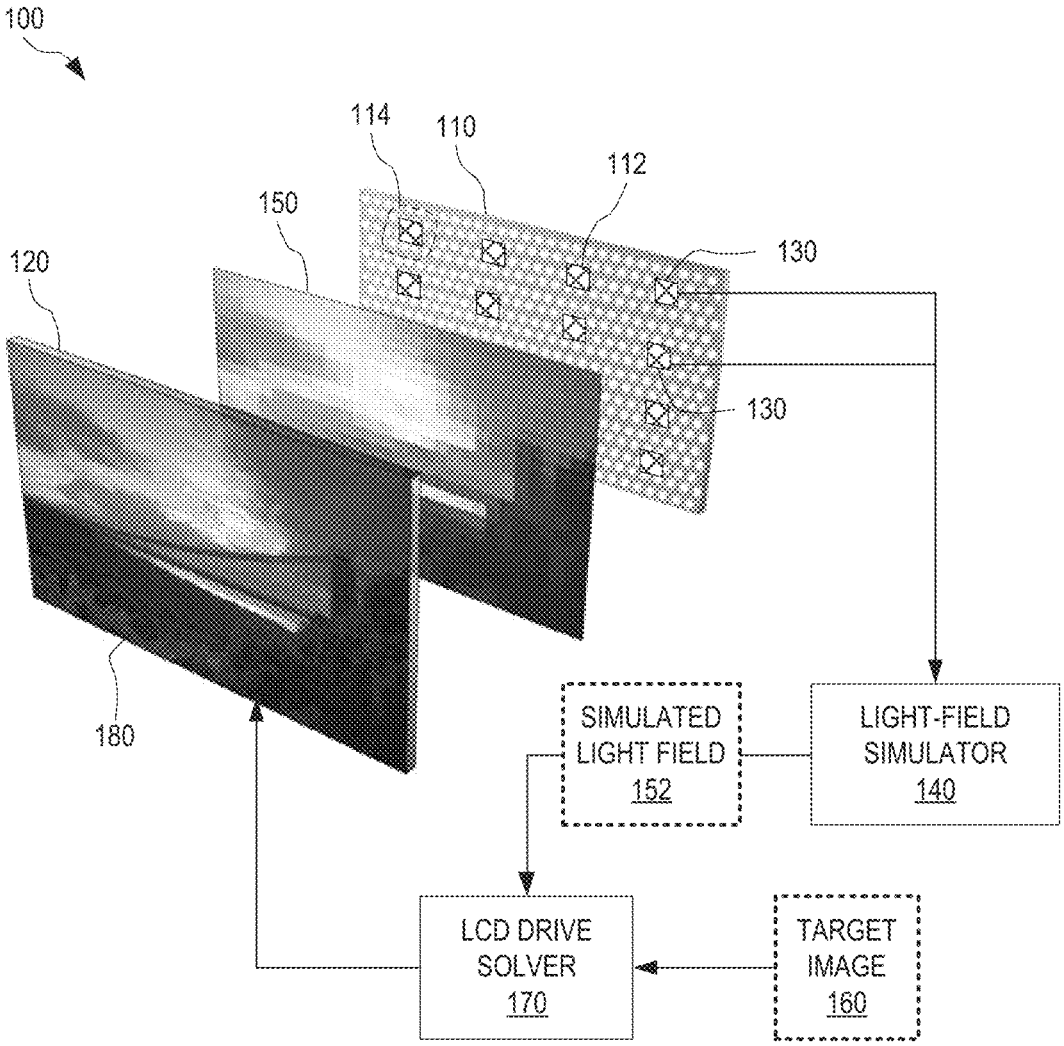
FIG. 1 is a perspective view of a display system with temperature compensation, according to an embodiment.
Figure 2:
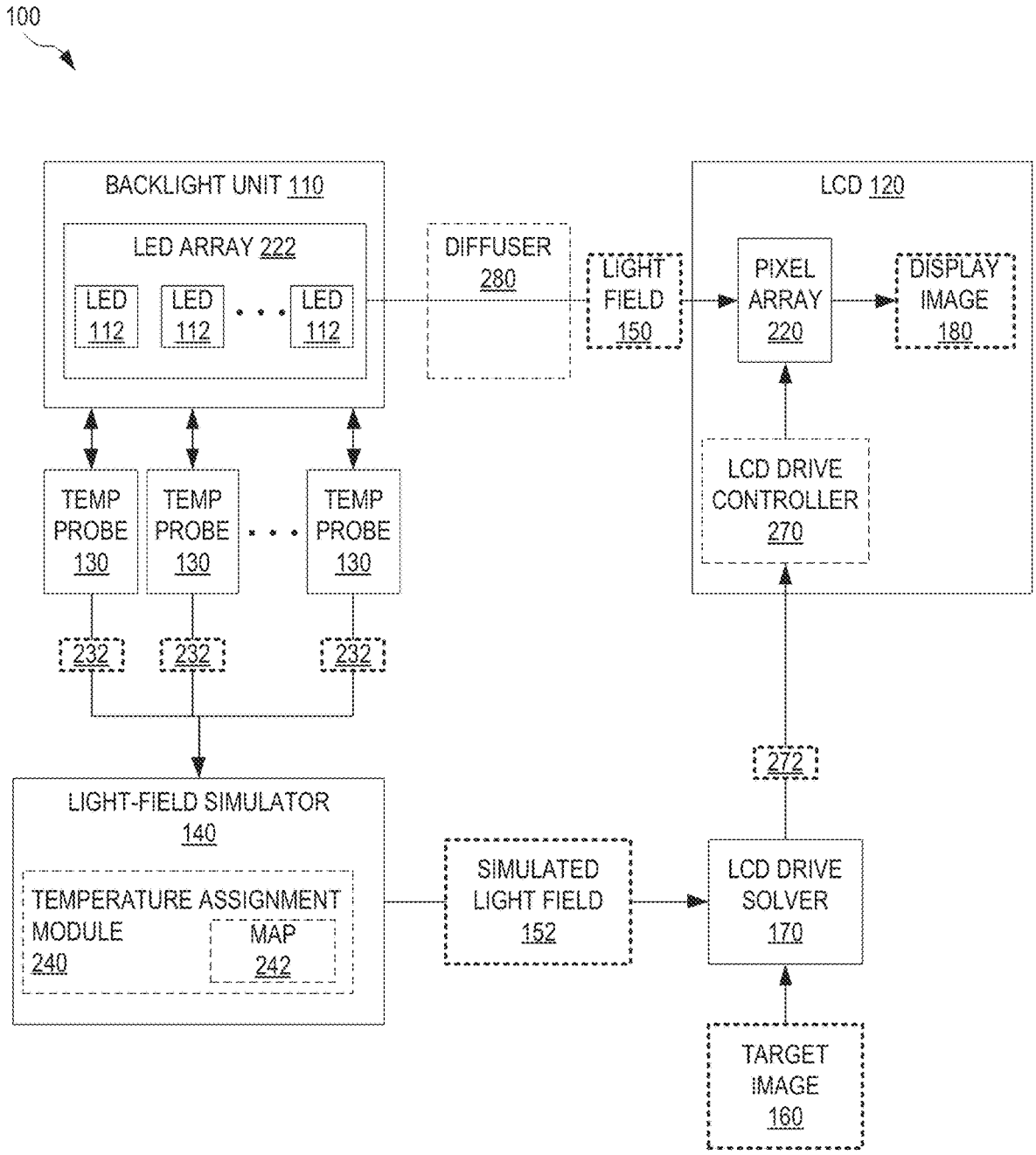
FIG. 2 is a block diagram of the display system of FIG. 1.

FIGS. 1 and 2 illustrate one exemplary display system 100 with temperature compensation. FIG. 1 is a perspective view of display system 100, and FIG. 2 is a block diagram of display system 100. FIGS. 1 and 2 are best viewed together.

Display system 100 includes a backlight unit 110 and a liquid crystal display (LCD) 120. Backlight unit 110 includes an LED array 222 of light-emitting diodes (LEDs) 112 that generate a light field 150 at LCD 120 so as to illuminate LCD 120. For clarity of illustration, not all LEDs 112 are labeled in FIG. 1. Additionally, it is understood that LED array 222 may include more or fewer LEDs 112 than shown in FIGS. 1 and 2 without departing from the scope hereof. Display system 100 also includes a plurality of temperature probes 130 mounted to backlight unit 110. Each temperature probe 130 measures a local temperature 232 at LED array 222. LCD 120 includes a pixel array 220 that modulates the transmission of light field 150 to display an image 180 on LCD 120. Each temperature probe 130 may include a thermistor, a thermocouple, an optical temperature sensor, or a temperature sensor known in the art.

In one embodiment, display system 100 displays monochrome images. In another embodiment, display system 100 displays color images. In this color-enabled embodiment, each LED 112 may be a white-light LED. Alternatively, the color-enabled embodiment implements each LED 112 as a color-specific LED (such as a red, green, or blue LED), wherein LEDs 112 are arranged in clusters or packages that each include a plurality of color-specific LEDs emitting different colors. In an example, each cluster or package includes a red LED, a green LED, and a blue LED. Furthermore, in the color-enabled embodiment, LCD 120 includes color filters.

Display system 100 further includes a light-field simulator 140 and an LCD drive solver 170. Light-field simulator 140 simulates the light field 150 at LCD 120 based upon temperatures 232 received from temperature probes 130. Light-field simulator 140 thereby generates a simulated light field 152 which takes into account local temperatures of LED array 222, at least in an approximate manner. LCD drive solver 170 is communicatively coupled with light-field simulator 140 and processes simulated light-field 152 and a target image 160 to determine LCD drive values 272 for the pixels of LCD 120 required to display an image 180 on LCD 120, which is substantially target image 160 or an approximation thereof. Since light-field simulator 140 accounts (at least approximately) for the temperatures of LED array 222, LCD drive values 272 compensate for temperature-induced changes in power output of LEDs 112.

LCD drive solver 170 communicates LCD drive values 272 to LCD 120. In an embodiment, display system 100 includes an LCD drive controller 270 that drives the pixels of pixel array 220 according to LCD drive values 272. In this embodiment, LCD drive solver 170 communicates LCD drive values 272 to LCD drive controller 270. LCD drive controller 270 may be implemented within LCD 120, as shown in FIG. 2, or externally to LCD 120 but in communicative coupling with pixel array 220.

Light-field simulator 140 may first determine or estimate the light output of each LED 112 based upon known LED drive values and pre-calibrated knowledge of the effect of temperature on the output of LEDs 112 and next compute, for example according to procedures known in the art, the propagation of the light output of each LED 112 to LCD 120.

It is understood that the temperature compensation performed by display system 100 may or may not be perfect. Without departing from the scope hereof, display image 180 may differ slightly from target image 160. For example, display image 180 may be substantially identical to target image 160, or display image 180 may be the closest approximation to target image 160 that display system 100 is capable of producing.

In certain embodiments, display system 100 is configured for dual-modulation, wherein the power output of LEDs 112 is adjusted to locally modulate the brightness of light field 150. In one such embodiment, the power output of each LED 112 is individually adjustable. In another such embodiment, LED array 222 is divided into zones 114 of LEDs 112, and the power output of each zone 114 is individually adjustable. For clarity of illustration, only a single zone 114 is indicated in FIG. 1. However, it is understood that backlight unit 110 of this embodiment of display system 100 includes several zones 114 of LEDs 112. In these dual-modulation embodiments of display system 100, drive values for individual LEDs 112 or zones 114 are adjusted according to target image 160. Subject to the resolution of LEDs 112 or zones 114, areas of LCD 120 intended to display brighter portions of target image 160 are illuminated more strongly than areas of LCD 120 intended to display dimmer portions of target image 160. Dual-modulation embodiments of display system 100 are explained in further detail below in reference to FIG. 7.

Although not shown in FIGS. 1 and 2, dual-modulation embodiments of display system 100 may, in combination with modulating the pixels of LCD 120 based upon simulated light-field 152 and target image 160, also adjust the power output of LEDs 112. In such embodiments, the drive values for LCD 120 selected by LCD drive solver 170 cooperate with adjustment of power output of LEDs 112 to display target image 160 as compensated for temperatures of LED array 222. However, adjustment of the LED drive values to achieve temperature compensation may be less advantageous than adjustment of LCD drive values 272, since adjustment of the LED drive values may change the temperature of LEDs 112. For example, if the power output of one LED 112 is lower than intended due to a high temperature at this LED 112, an increase in drive value for this LED 112 to compensate for the high temperature may result in further decrease of the power output, thereby exacerbating the temperature effect rather than compensating for the temperature effect. Therefore, display system 100 exclusively, or predominantly, relies on proper setting of LCD drive values 272, as determined by LCD drive solver 170, to achieve temperature compensation.

The number of LEDs 112 may exceed the number of temperature probes 130. Furthermore, regardless of the number of temperature probes 130 relative to the number of LEDs 112, the positions of temperature probes 130 on backlight unit 110 may or may not coincide with the positions of LEDs 112. Thus, there is not necessarily a one-to-one correspondence between temperature probes 130 and LEDs 112. In an embodiment, light-field simulator 140 includes a temperature assignment module 240. Temperature assignment module 240 assigns a temperature to each LED 112 based upon measured temperatures 232. In one implementation, temperature assignment module 240 includes a map 242 that assigns, to each LED 112, a particular one of measured temperatures 232. In one example of this implementation, map 242 assigns to each LED 112 temperature 232 measured by the nearest temperature probe 130. In another example of this implementation, map 242 assigns to each LED 112 a temperature 232 measured by the temperature probe 130 known to most be most strongly affected by the drive value of the LED 112 in question. In another implementation, temperature assignment module 240 assigns, to each of at least some of LEDs 112, a temperature that is not a directly measured temperature 232 but rather a temperature derived from measured temperatures 232. In one example of this implementation, temperature assignment module 240 assigns, to each of at least some of LEDs 112, a temperature that is a weighted average of two or more temperatures 232 measured by temperature probes 130 nearest the LED 112 in question. In another example of this implementation, temperature assignment module 240 assigns, to each LED 112, a temperature interpolated from measured temperatures 232 according to the spatial relationship between LED 112 in question and the nearest temperature probes 130.

In an embodiment, display system 100 includes a diffuser 280 positioned between backlight unit 110 and LCD 120. Diffuser 280 diffuses light generated by LED array 222 to relatively evenly illuminate pixel array 220 (apart from intentional spatial modulation in dual-modulation embodiments of display system 100). In this embodiment, light-field simulator 140 takes into account diffuser 280 when generating simulated light field 152.

Figure 3:
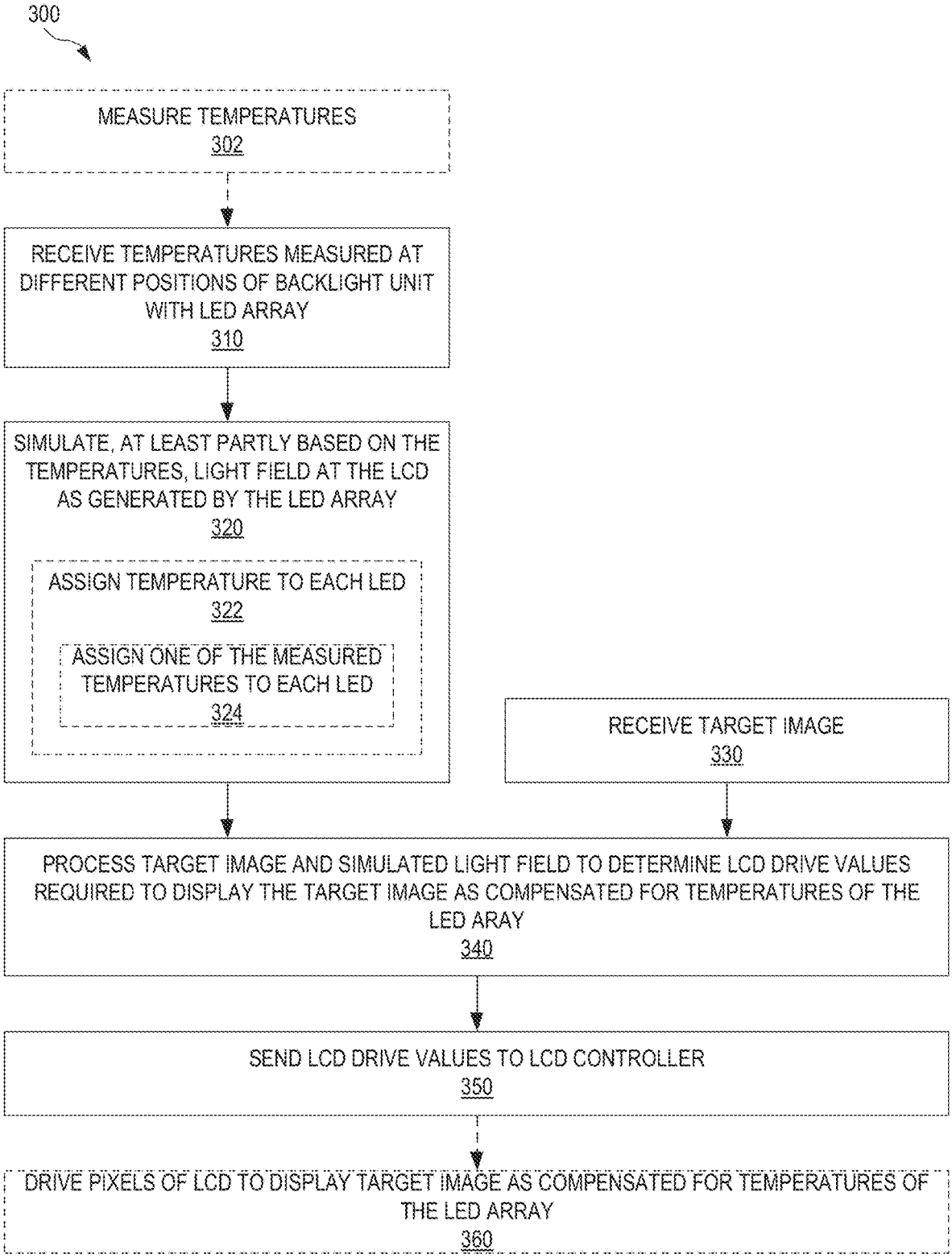
FIG. 3 is a flowchart for a method for temperature compensation of a LED-backlit LCD system, according to an embodiment.

FIG. 3 illustrates one exemplary method 300 for temperature compensation of a LED-backlit LCD system. Method 300 is performed by display system 100, for example. Certain embodiments of method 300 may be performed by light-field simulator 140 and LCD drive solver 170 alone.

In a step 310, method 300 receives a plurality of temperatures measured at different respective positions of the backlight unit of an LED-backlit LCD system. The backlight unit includes an LED array to illuminate an LCD. In one example of step 310, light-field simulator 140 receives temperatures 232 measured by temperature probes 130.

In a step 320, method 300 simulates, at least partly based upon the temperatures received in step 310, the light field at an LCD that is backlit by the backlight unit associated with the temperatures of step 310. The light field is generated by the LED array of the backlight unit. In one example of step 320, light-field simulator 140 performs a simulation of light field 150 to produce simulated light field 152.

In an embodiment, step 320 includes a step 322 of assigning a temperature to each of the LEDs of the LED array of the backlight unit. In one example of step 322, temperature assignment module 240 assigns to each LED 112 a respective temperature derived from temperatures 232, as discussed above in reference to FIGS. 1 and 2. Step 322 may include a step 324 of assigning, to each LED, one of the temperatures received in step 310. In one example of step 324, temperature assignment module 240 assigns, to each LED 112, one of temperatures 232, for example according to map 242, as discussed above in reference to FIGS. 1 and 2.

In a step 330, method 300 receives a target image intended to be displayed on the LCD. In one example of step 330, LCD drive solver 170 receives target image 160.

A step 340 processes the target image, received in step 330, and the simulated light field, generated in step 320, to determine LCD drive values required to display the target image as compensated for temperatures of the LED array. In one example of step 340, LCD drive solver 170 processes target image 160 and simulated light field 152 to determine LCD drive values 272 required for LCD 120 to display of a display image 180 that is substantially target image 160 or a close approximation thereof.

In a step 350, method 300 sends LCD drive values to an LCD controller that controls the pixel array of the LCD. In one example of step 350, LCD drive solver 170 sends LCD drive values 272 to LCD drive controller 270.

In an embodiment, method 300 further includes a step 360 of driving pixels of the LCD to display the target image as compensated for temperatures of the LED array. In one example of step 360, LCD drive controller 270 drives pixels of pixel array 220 to display an image 180 displayed that is substantially target image 160 or a close approximation thereof.

Method 300 may also include a step 302, performed prior to step 310, of measuring the temperatures of step 310. In one example of step 302, temperature probes 130 measure temperatures 232.

In certain embodiments, method 300 is performed repeatedly to display a video or image stream on the LCD, wherein the video or image stream is compensated for temperatures of the LED array. In such embodiments, steps 330, 340, 350, and optionally step 360 (if included) may be performed at a higher rate than step 310 and step 302 (if included). A typical video frame rate is in the range between 24 Hertz and 60 Hertz. However, temperature changes generally occur on a time scale of one or several seconds, for example in the range 1-300 seconds. Therefore, it may be unnecessary to update temperature measurements 232 for every new image to be displayed. It may be sufficient to update temperatures 232 at a rate of about one Hertz or between 0.1 and 1 Hertz. In one such embodiment, method 300 is applied to a dual-modulation embodiment of display system 100, and step 320 is performed at the same rate as step 330, or at a rate that is comparable to the rate of adjustment of LED drive values. In another such embodiment, method 300 is applied to a display system that adjusts only LCD drive values while leaving the LED drive values constant. In this embodiment, step 330 may be performed at the same rate as step 310.

An embodiment of method 300 that does not include steps 302 and 360 may be performed by light-field simulator 140 and LCD drive solver 170 alone. This embodiment of method 300 may be implemented as a software product in the form of machine-readable instructions encoded in a non-transitory medium, for example a non-volatile medium. A processor may execute the machine-readable instructions to perform this embodiment of method 300.

Figure 4:
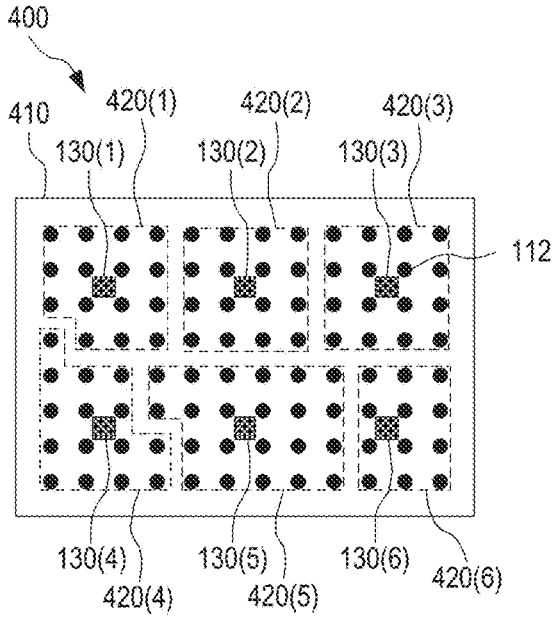
FIG. 4 illustrates a temperature-monitored backlight module, according to an embodiment.

FIG. 4 illustrates one exemplary temperature-monitored backlight module 400. Temperature-monitored backlight module 400 includes a backlight unit 410 with a plurality of temperature probes 130 attached thereto. Backlight unit 410 is an embodiment of backlight unit 110, and temperature-monitored backlight module 400 is an embodiment of backlight unit 110 and temperature probes 130 in combination.

Backlight unit 410 includes a plurality of LEDs 112 arranged in an array. The number of LEDs 112 and/or the array layout may be different from that shown in FIG. 4, without departing from the scope hereof. For example, while FIG. 4 shows LEDs 112 arranged in a rectangular grid, LEDs 112 may instead be arranged in a honeycomb pattern, or another regular or irregular pattern. For clarity of illustration, not all LEDs 112 are labeled in FIG. 4.

Temperature probes 130 are coupled to backlight unit 410 in a pattern that may be equally spaced, as shown in FIG. 4, or unevenly spaced. Temperature probes 130 may be attached to a side of backlight unit 410 configured to face LCD 120, a side of backlight unit 410 configured to face way from LCD 120, or along the edge of backlight unit 410. Alternatively, one or more of temperature probes 130 may be fully or partly embedded within backlight unit 410.

The number of LEDs 112 exceeds the number of temperature probes 130. When implemented in display system 100, backlight module 400 may be associated with an embodiment of map 242 that reflects groups 420. Specifically, this embodiment of map 242 assigns the temperature 232 measured by temperature probe 130(*n*) to every LED 112 within group 420(*n*), wherein n=1 . . . 6. Without departing from the scope hereof, the number of temperature probes 130, and associated groups 420, may be different from that shown in FIG. 4. Likewise, the shapes and sizes of groups 420 may be different from those shown in FIG. 4.

In one implementation, temperature-monitored backlight module 400 includes thousands of LEDs 112 and between 10 and 1000 temperature probes 130.

Figure 5A:
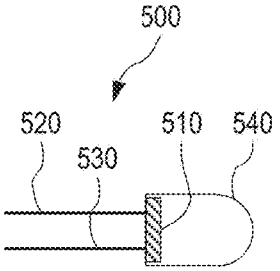
FIG. 5A illustrates a white-light LED package, according to an embodiment.

FIG. 5A illustrates one exemplary white-light LED package 500 configured for implementation in an embodiment of backlight unit 110 or an embodiment of backlight unit 410. White-light LED package 500 is an embodiment of LED 112, and is well-suited for use in an embodiment of display system 100 configured to display color images. White-light LED package 500 includes an LED-based emitter 510 that emits white light. LED-based emitter 510 is for example a phosphor coated LED, or an LED-based white light emitter known in the art. White-light LED package 500 has two electrical connections 520 and 530. In an embodiment, electrical connection 530 is grounded, or coupled to a fixed potential, and electrical connection 520 is driven according to an associated LED drive value. White-light LED package 500 further includes a lens 540 that collects and focuses light emitted by LED-based emitter 510.

Figure 5B:
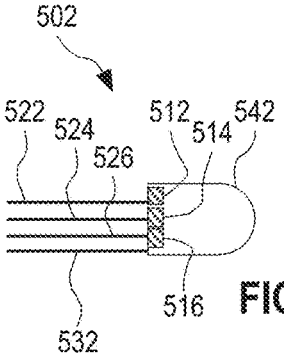
FIG. 5B illustrates an integrated multicolored LED package, according to an embodiment.

FIG. 5B illustrates one exemplary integrated multicolored LED package 502 configured for implementation in an embodiment of backlight unit 110 or an embodiment of backlight unit 410. Integrated multicolored LED package 502 embodies a set of three adjacent LEDs 112 implemented in a common package, and is well-suited for use in an embodiment of display system 100 configured to display color images. Integrated multicolored LED package 502 includes color-specific LEDs 512, 514, and 516, each configured to emit light of a different respective color, for example red, green, and blue. Each of color-specific LEDs 512, 514, and 516 is an embodiment of LED 112. Color-specific LEDs 512, 514, and 516 can be driven together to produce white light or a plurality of narrower-band spectra (e.g., individual R, G, and B emission spectra), such that color-specific LEDs 512, 514, and 516 together with color filters of LCD 120 can produce a color image on LCD 120. Integrated multicolored LED package 502 includes four electrical connections: a common anode or common cathode 532, a drive connection 522 for driving LED 512 according to a corresponding LED drive value, a drive connection 524 for driving LED 514 according to a corresponding LED drive value, and a drive connection 526 for driving LED 516 according to a corresponding LED drive value. Integrated multi-colored LED package 502 further includes a lens 542 that collects and focuses light emitted by LEDs 512, 514, and 516. Integrated multicolored LED package 502 allows for separate control of LEDs 512, 514, and 516.

Figure 5C:
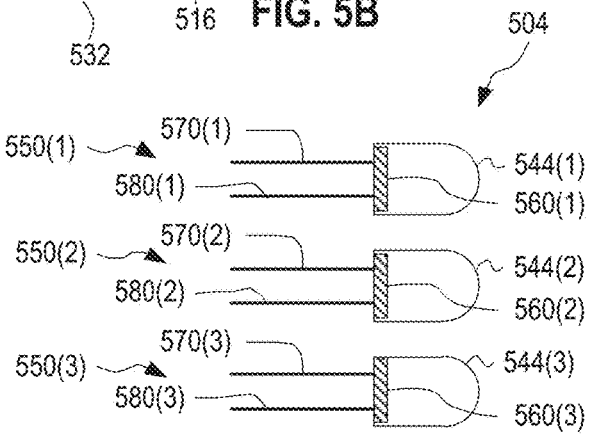
FIG. 5C illustrates a multicolored cluster of LED packages, according to an embodiment.

FIG. 5C illustrates one exemplary multicolored cluster 504 of LED packages 550 configured for implementation in an embodiment of backlight unit 110 or an embodiment of backlight unit 410. Multicolored cluster 504 embodies three adjacent LEDs 112, and is well-suited for use in an embodiment of display system 100 configured to display color images. Multicolored cluster 504 includes color-specific LED packages 550(*m*), m=1 . . . 3, configured to emit light of different respective colors, such as red, green, and blue light. Each color-specific LED package 550(*m*) is an embodiment of LED 112. Each color-specific LED package 550(*m*) includes an LED 560(*m*), electrical connections 570(*m*) and 580(*m*) for driving LED 560(*m*), and a lens 544(*m*) that collects and focuses light emitted by LED 550(*m*). Each electrical connection 570(*m*) may be grounded or coupled to a fixed potential, and each electrical connection 580(*m*) is driven according to an associated LED drive value. Multicolored cluster 504 allows for separate control of each of LED packages 550(*m*).

Figure 6:
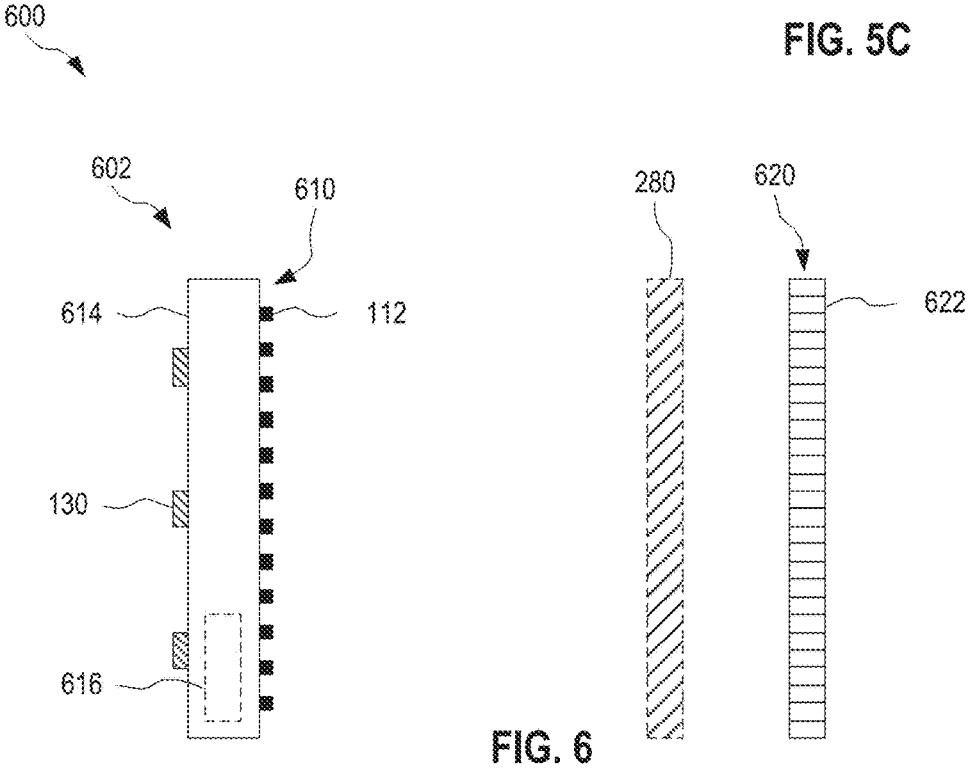
FIG. 6 illustrates an LED-backlit liquid crystal display module, according to an embodiment.

FIG. 6 is a cross-sectional view of one exemplary LED-backlit liquid crystal display module 600. Display module 600 includes a backlight unit 602, an LCD 620 with an array of pixels 622, and temperature probes 130. Backlight unit 602 is an embodiment of backlight unit 110. LCD 620 is an embodiment of LCD 120. The array of pixels 622 is an embodiment of pixel array 220. In an embodiment, display module 600 further includes diffuser 280.

Backlight unit 610 includes a circuit board 614, for example a printed circuit board. LEDs 112 are mounted on the side of circuit board 614 facing LCD 620. Temperature probes 130 are mounted to the side of circuit board 614 facing away from LCD 620. LEDs 112 and temperature probes 130 may be arranged according to the embodiment shown in FIG. 4. In an alternate embodiment, not shown in FIG. 6, both LEDs 112 and temperature probes 130 are mounted to the side of circuit board 614 facing LCD 620.

Circuit board 614 may include circuitry 616 that controls LEDs 112. Optionally, circuitry 616 also provides a communication interface for and/or control of temperature probes 130.

The number of LEDs 112, the number of temperature probes 130, and/or the number of pixels 622 may be different from what is shown in FIG. 6, without departing from the scope hereof. For clarity of illustration, not all LEDs 112, not all temperature probes 130, and not all pixels 622 are labeled in FIG. 6. In certain embodiments, the number of pixels 622 exceeds the number of LEDs 112, and the number of LEDs 112 exceeds the number of temperature probes 130.

In one implementation, LED-backlit liquid crystal display module 600 includes millions of pixels 622, thousands of LEDs 112, and between 10 and 1000 temperature probes 130.

Figure 7:
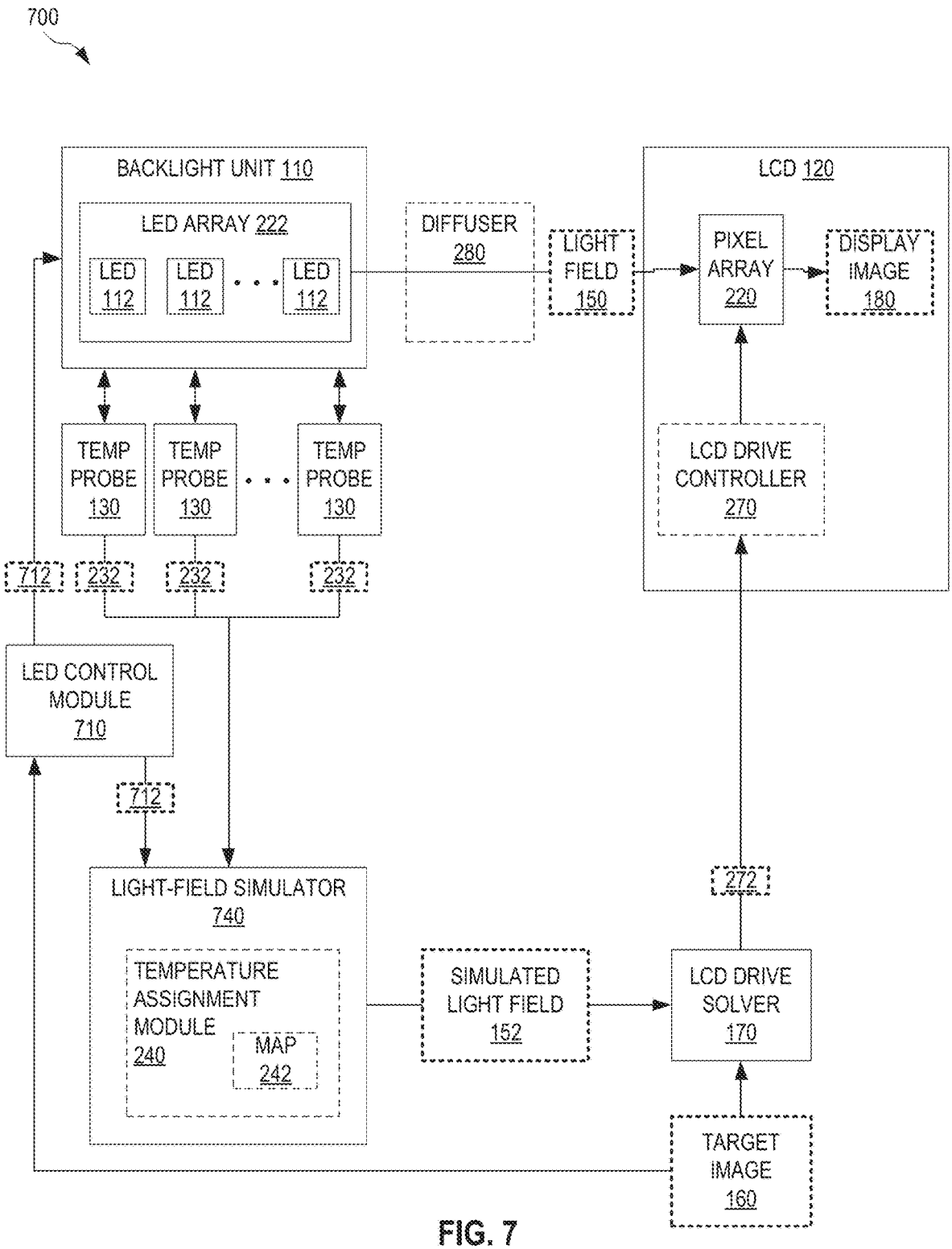
FIG. 7 illustrates a dual-modulation display with temperature compensation, according to an embodiment.

FIG. 7 illustrates one exemplary dual-modulation display system 700 with temperature compensation. Dual-modulation display system 700 is an embodiment of display system 100, which further includes an LED control module 710 and which implements light-field simulator 140 as a light-field simulator 740. LED control module 710 receives target image 160 and determines LED drive values 712 for LEDs 112 suitable for displaying target image on LCD 120. For example, LED control module 710 may use (a) a relatively low drive value 712 for LEDs 112 illuminating a portion of pixel array 220 associated with a dim portion of target image 160 and (b) a relatively high drive value 712 for LEDs 112 illuminating a portion of pixel array 220 associated with a bright portion of target image 160.

In an embodiment of dual-modulation display system 700, LEDs 112 are multicolored LEDs, wherein each color is separately controllable. For example, each LED 112 may be implemented as integrated multicolored LED package 502 or multicolored cluster 504. In this embodiment, LED control module 710 may set LED drive values 712 to adjust brightness, color, or both, according to the properties of target image 160.

LED control module 710 communicates LED drive values 712 to backlight unit 110 and to light-field simulator 740. Backlight unit 110, for example using circuitry 616, drives LEDs 112 according to LED drive values 712. Light-field simulator 740 is configured to take into account LED drive values 712 when calculating simulated light field 152, so as to properly simulate light field 150.

Without departing from the scope hereof, dual-modulation display system 700 may in combination with modulating the pixels of LCD 120 based upon simulated light-field 152 and target image 160, also adjust the power output of LEDs 112 using LED control module 710. However, as discussed above in reference to FIGS. 1 and 2, dual-modulation display system 700 exclusively, or predominantly, relies on proper setting of LCD drive values 272, as determined by LCD drive solver 170, to achieve temperature compensation.

Figure 8:
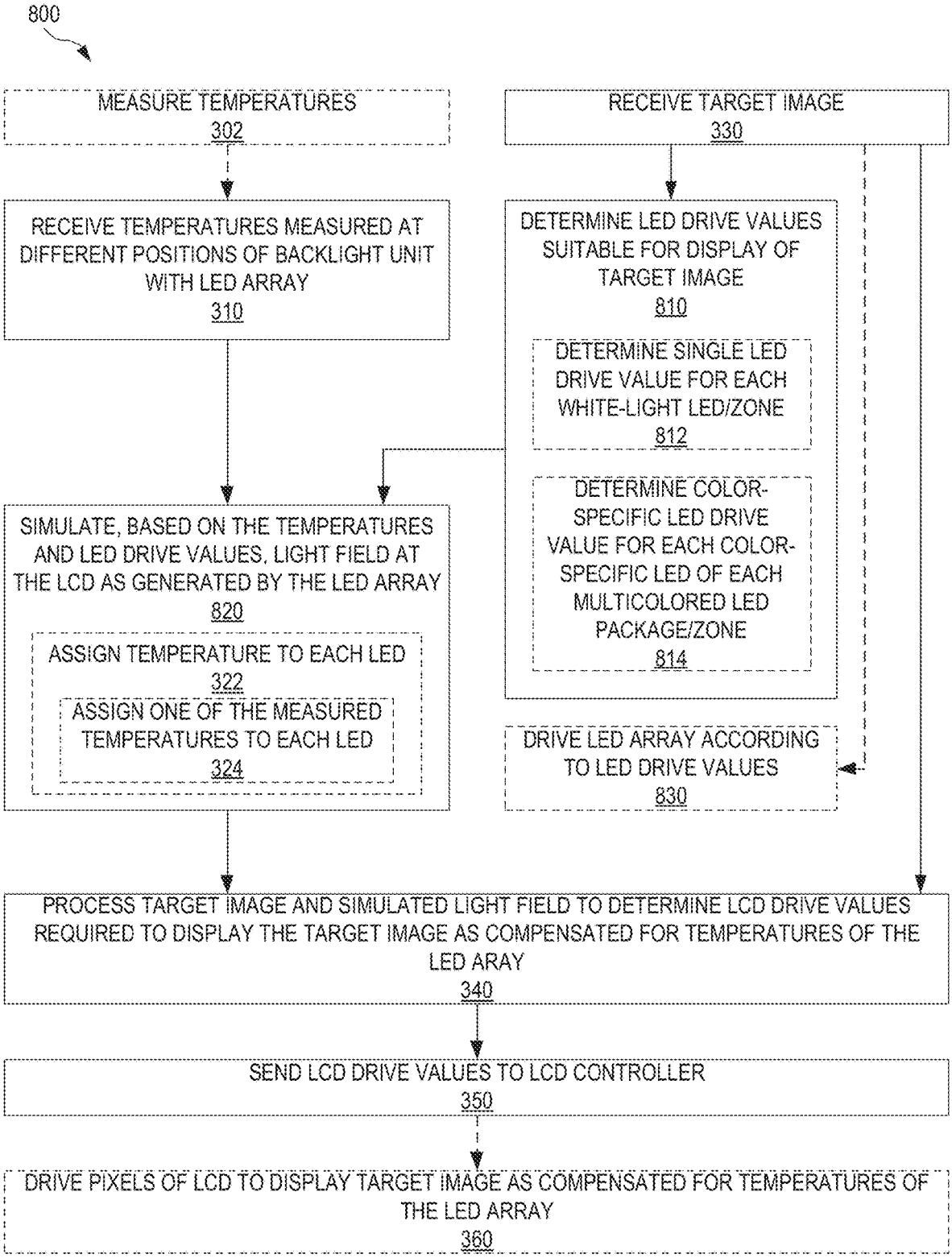
FIG. 8 illustrates a method for temperature compensation of a dual-modulation LED-backlit LCD system, according to an embodiment.

FIG. 8 illustrates one exemplary method 800 for temperature compensation of a dual-modulation LED-backlit LCD system. Method 800 is an embodiment of method 300, specifically tailored for use with a dual-modulation display system. Method 800 is performed by dual-modulation display system 700, for example. Certain embodiments of method 800 may be performed by LED control module 710, light-field simulator 740, and LCD drive solver 170 alone.

Method 800 is similar to method 300. As compared to method 300, method 800, step 320 is implemented as a step 820, and method 800 further includes a step 810 and, optionally, also a step 830.

Step 810 processes the target image received in step 330 to determine LED drive values suitable for display of the target image. In one example of step 810, LED control module 710 processes target image 160 to determine LED drive values 712 suitable for display of target image 160 on LCD 120.

In one embodiment of step 810, tailored for use with an embodiment of dual-modulation display system 700 that implements white-light LEDs such as white-light LED packages 500, step 810 includes a step 812. Step 812 determines a single LED drive value for each white-light LED or for each of a plurality of LED zones. In one example, each LED 112 of backlight unit 110 is a white-light LED package 500, and step 812 determines a single LED drive value 712 for each white-light LED package 500. In another example, each LED 112 of backlight unit 110 is a white-light LED package 500, and step 812 determines a single LED drive value 712 to be used for all white-light LED packages 500 of each zone 114 of white-light LED packages 500.

Another embodiment of step 810 is tailored for use with an embodiment of dual-modulation display system 700 that implements color-specific LEDs, wherein different colors are separately adjustable. This embodiment of step 810 is used with, for example, (a) multicolored LEDs, such as integrated multicolored LED packages 502, or (b) multicolored clusters of LED packages, such as multicolored clusters 504. In this embodiment, step 810 includes a step 814. Step 814 determines a color-specific LED drive value for (a) each color-specific LED of each multicolor LED package, or zone thereof, or (b) each color-specific LED package of each multicolored cluster, or zone thereof. In one example of step 814, each LED 112 of backlight unit 110 is an integrated multicolored LED package 502, and step 814 determines a color-specific LED drive value 712 for each color-specific LED 512, 514, and 516, respectively, of each integrated multicolored LED package 502. Alternatively, this example of step 814 may utilize zones 114 and select the same color-specific LED drive values 712 to all color-specific LEDs 512, 514, and 516, respectively, within each zone 114. In another example of step 814, each LED 112 of backlight unit 110 is a multicolored cluster 504 of LED packages 550, and step 814 determines a color-specific LED drive value 712 for each color-specific LED package 550 of each multicolored cluster 504. Alternatively, this example of step 814 may utilize zones 114 and select the same color-specific LED drive values 712 to all color-specific LED packages 550, respectively, within each zone 114.

An optional step 830 drives the LED array according to the LED drive values determined in step 810. In one example of step 830, LED control module 710 communicates LED drive values 712 to backlight unit 110, for example to circuitry 616, and backlight unit 110 drives each LED 112 accordingly.

Step 820 simulates light field 150 based upon the temperatures received in step 310 and the LED drive values determined in step 810. Step 820 is similar to step 320, apart from also taking into account the LED drive values (e.g., LED drive values 712) determined in step 810. Step 820 may be performed by light-field simulator 740.

In certain embodiments, method 800 is performed repeatedly to display a video or image stream on the LCD, wherein the video or image stream is compensated for temperatures of the LED array. In such embodiments, step 310 (optionally together with step 302) may be performed at a lower rate than steps 330, 810, 820, 340, and 350, and optionally step 360 and/or step 830.

An embodiment of method 800 that does not include steps 302, 830, and 360 may be performed by LED control module 710, light-field simulator 740 and LCD drive solver 170 alone. This embodiment of method 800 may be implemented as a software product in the form of machine-readable instructions encoded in a non-transitory medium, for example a non-volatile medium. A processor may execute the machine-readable instructions to perform this embodiment of method 800.

Figure 9:
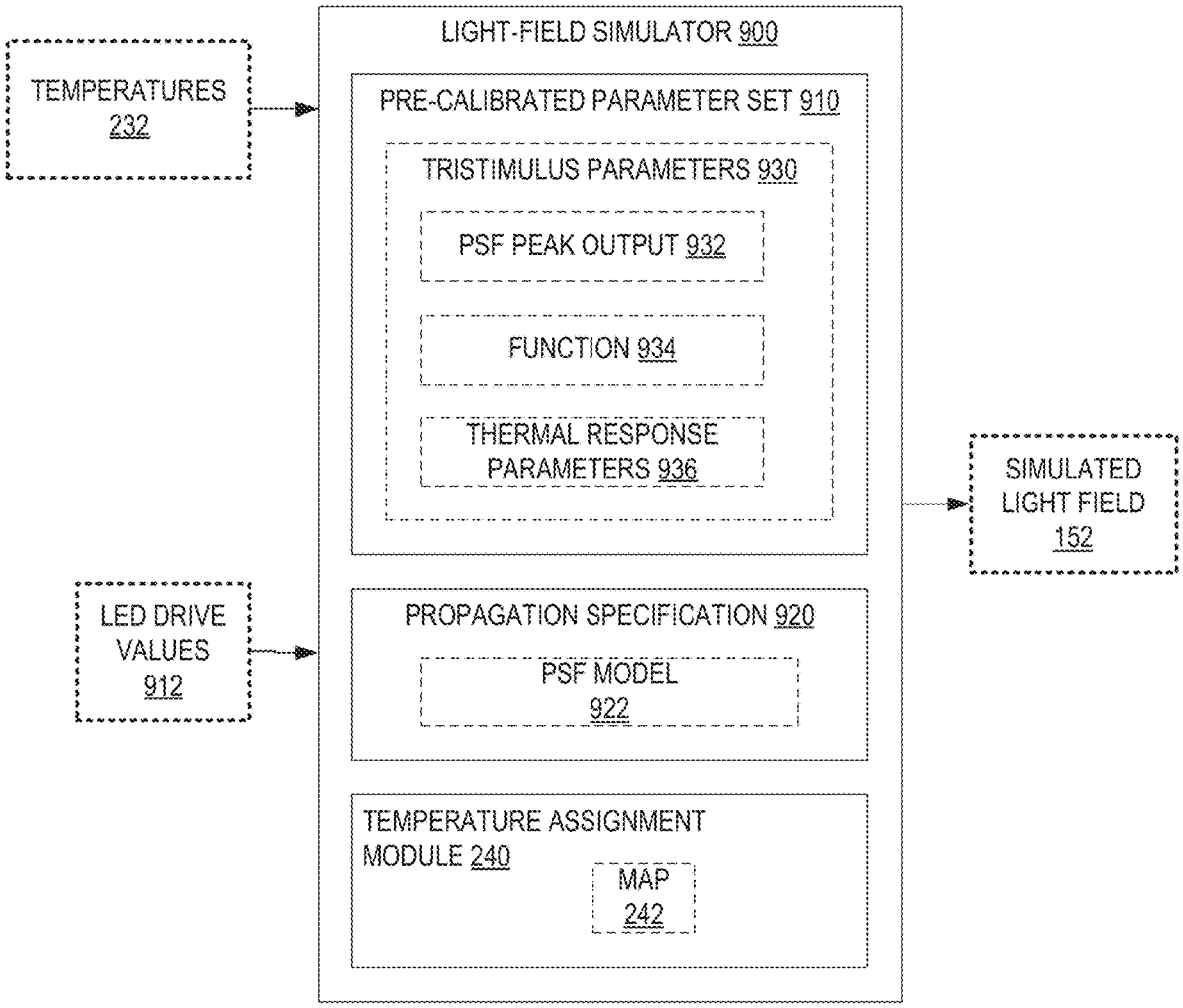
FIG. 9 illustrates a light-field simulator that includes a pre-calibrated parameter set, according to an embodiment.

FIG. 9 illustrates one exemplary light-field simulator 900 that includes a pre-calibrated parameter set 910. Light-field simulator 900 is an embodiment of light-field simulator 140. Light-field simulator 900 may be implemented in display system 100 or dual-modulation display system 700. Light-field simulator 900 may perform step 320 of method 300 or step 820 of method 800.

Light-field simulator 900 processes temperatures 232 and LED drive values 912, using pre-calibrated parameter set 910, to simulate the light output of LED array 222. For each LED 112, pre-calibrated parameter set 910 specifies the light output as a function of the LED drive value 912 and the temperature associated with the LED 112. The temperature associated with each LED 112 is derived from temperatures 232, as discussed above in reference to FIGS. 1 and 2. Light-field simulator 900 includes temperature assignment module 240 which assigns a temperature to each LED 112 based upon measured temperatures 232. Light-field simulator 900 may implement temperature assignment module 240 with map 242 and assign measured temperatures 232 to LEDs 112 according to map 242.

When light-field simulator 900 is implemented in dual-modulation display system 700, LED drive values 912 are LED drive values 712 determined by LED control module 710 based upon target image 160. When light-field simulator 900 is implemented in a non-dual-modulation display system 700, LED drive values 912 are pre-defined fixed LED drive values, for example. Without departing from the scope hereof, these pre-defined fixed LED drive values may be included in pre-calibrated parameter set 910, rather than received from outside light-field simulator 900.

Light-field simulator 900 also includes a propagation specification 920 that specifies the propagation of the light output of each LED 112 from backlight unit 110 to LCD 120. Propagation specification 920 takes into account spatial emission properties of LED 112, the distance from LED 112 to LCD 120, and optical components between LED 112 and LCD 120 such as diffuser 280. In an embodiment, propagation specification 920 includes a point spread function (PSF) model 922 which specifies the point spread function at LCD 120 for the light emitted by each LED 112. PSF model 922 may be determined in a calibration measurement. Light-field simulator 900 uses propagation specification 920 to simulate the propagation of the simulated light output of LED array 222 to LCD 120, thereby generating simulated light field 152.

In an embodiment, light-field simulator 900 is configured to simulate light field 150 of a color-enabled embodiment of display system 100 (or of display system 700), and pre-calibrated parameter set 910 specifies the light output of each LED 112 as corresponding tristimulus values X, Y, and Z of the CIE 1931 XYZ color space. Loosely, Y is the luminance (roughly analogous to the spectral sensitivity of M cones), Z is quasi-equal to blue stimulation (roughly analogous to the S cone response), and X is a mix of cone response curves chosen to be nonnegative. In this embodiment, pre-calibrated parameter set 910 includes tristumulus parameters 930, which is a set of pre-calibrated parameters that, for each LED 112, defines the tristimulus values X, Y, and Z for LED 112 in cooperation with the associated LED drive value(s) 912 and the associated temperature derived from temperatures 232.

Tristumulus parameters 930 may include a PSF peak output 932, a function 934, and thermal response parameters 936. PSF peak output 932 specifies, for each LED 112, pre-calibrated values of three proportionality factors $X_0$, $Y_0$, and $Z_0$ between the respective X, Y, and Z tristimulus values and LED drive value 912 for LED 112 at a particular temperature. Function 934 specifies a functional relationship between (a) the X, Y, and Z tristimulus values and (b) LED drive value 912 and temperature associated with LED 112. Function 934 includes the proportionality factors $X_0$, $Y_0$, and $Z_0$, such that function 934 is a linear function of LED drive value 912. Function 934 also includes parameters for the thermal response of the X, Y, and Z tristimulus values, and thermal response parameters 936 are pre-calibrated values for these parameters. In one embodiment, function 934 is a polynomial function of the temperature associated with LED 112, such as a quadratic polynomial function, a cubic polynomial function, or a higher-order polynomial function. In another embodiment, function 934 is different from a strictly polynomial function of the temperature associated with LED 112.

Without departing from the scope hereof, tristimulust parameters 930 may be a look-up table that cooperatively implements PSF peak output 932, function 934, and thermal response parameters 936 without separately defining function 934 and pre-calibrated parameters thereof.

Figure 10A:
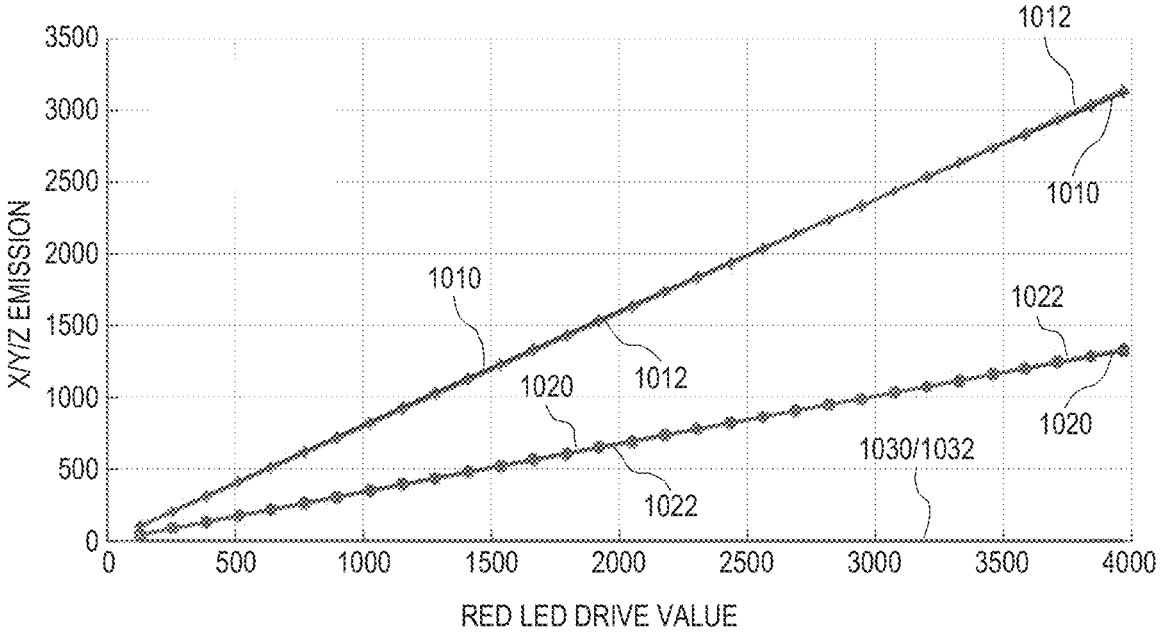
FIGS. 10A and 10B show exemplary measured relationships between the X, Y, and Z tristimulus values, LED drive value, and temperature.
Figure 10B:
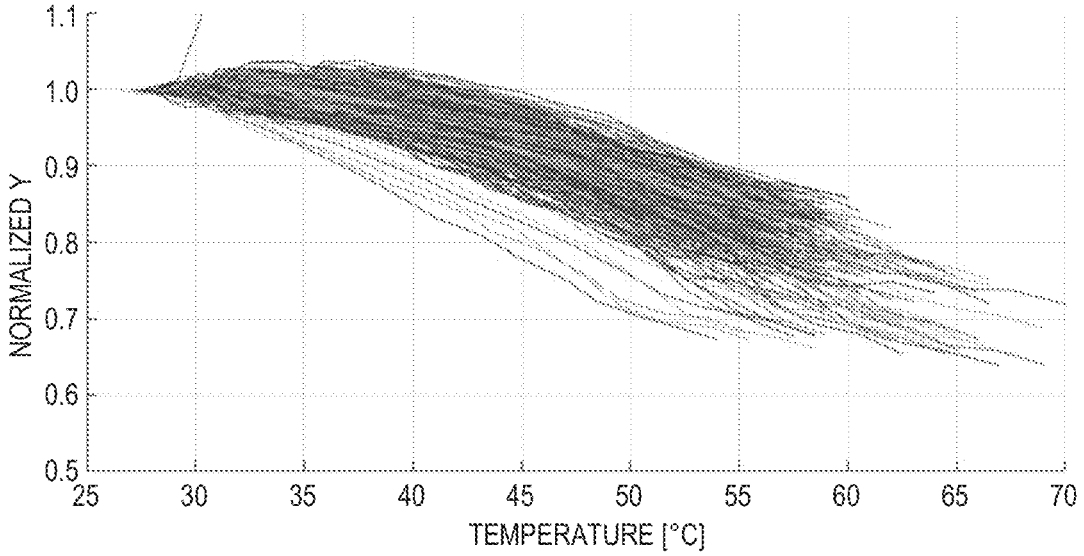

FIGS. 10A and 10B show exemplary measured relationships, for exemplary red LEDs 112, between the X, Y, and Z tristimulus values, LED drive value 912, and a temperature associated with the red LED 112. FIGS. 10A and 10B are best viewed together with FIG. 9 and together with the following description.

FIG. 10A shows measured X, Y, and Z tristimulus values for one red LED 112, at an associated temperature of 30° C., as a function of LED drive value 912 for the red LED 112. Data 1010 is the measured X tristimulus value, and data 1012 is a linear fit to data 1010. Data 1020 is the measured Y tristimulus value, and data 1022 is a linear fit to data 1020. Data 1030 is the measured Z tristimulus value, and data 1032 is a linear fit to data 1030. For each of the X, Y, and Z tristimulus values, differences between the measured tristimulus value and the linear fit are almost indiscernible. This demonstrates the validity of assuming a linear relationship, as characterized by function 934 and PSF peak output 932, between the X, Y, and Z tristimulus values and LED drive value 912.

FIG. 10B shows the normalized measured Y tristimulus value for a plurality of red LEDs 112 as a function of the respective temperature associated therewith. The relationship between the Y tristimulus value and temperature is generally not linear but may, with reasonably accuracy, be described by a cubic polynomial function, wherein the coefficients of the cubic polynomial are specific to each individual LED 112. Thus, in one embodiment, function 934 is of the form:

$$\begin{bmatrix} X_i(T, C_i) \\ Y_i(T, C_i) \\ Z_i(T, C_i) \end{bmatrix} = \begin{bmatrix} X_0(a_i^x T^3 + b_i^x T^2 + c_i^x T + d_i^x) \\ Y_0(a_i^y T^3 + b_i^y T^2 + c_i^y T + d_i^y) \\ Z_0(a_i^z T^3 + b_i^z T^2 + c_i^z T + d_i^z) \end{bmatrix} \cdot C_i, \quad \text{(Eq. 1)}$$

wherein $X_i$, $Y_i$, and $Z_i$ are the tristimulus values for the i'th LED 112, $C_i$ is LED drive value 912 for the i'th LED 112, T is the temperature associated with the i'th LED 112, and $(a_i^x, b_i^x, c_i^x, d_i^x)$, $(a_i^y, b_i^y, c_i^y, d_i^y)$, and $(a_i^z, c_i^z, d_i^z)$ are the cubic polynomial coefficients for the i'th LED 112. In this embodiment, thermal response parameters 936 specify the value of each cubic polynomial coefficient.

Figure 11:
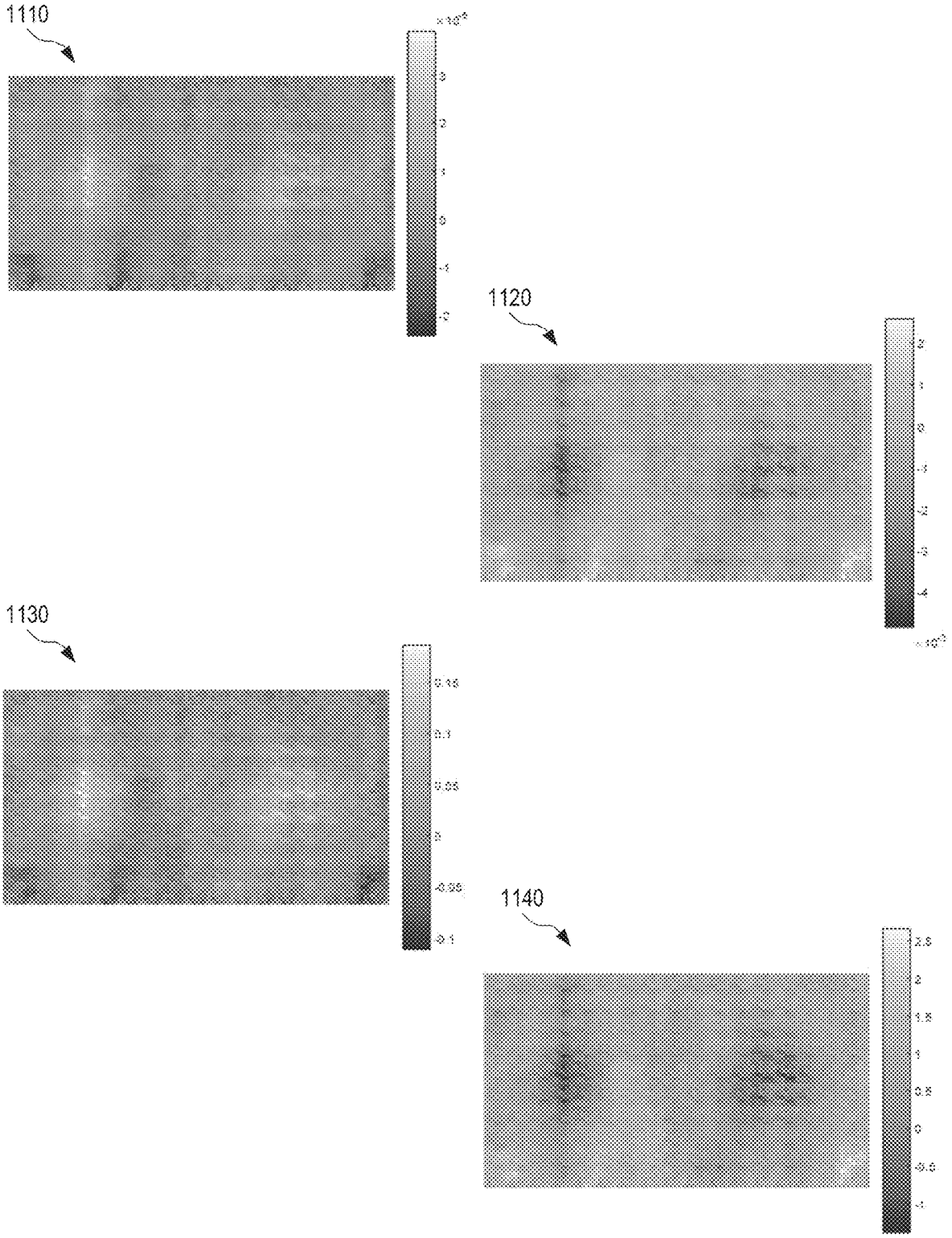
FIG. 11 shows exemplary maps of cubic polynomial coefficients for one of the X, Y, and Z tristimulus values for all LEDs of a certain color within an embodiment of the LED array of the display system of FIGS. 1 and 2.

FIG. 11 shows exemplary maps of cubic polynomial coefficients (a, b, c, d) for one of the X, Y, and Z tristimulus values for all LEDs 112 of a certain color within an embodiment of LED array 222. In an example, (a, b, c, d) represents $b_i^y$, $c_i^y$, $d_i^y$) for all red LEDs 112 of this embodiment of LED array 222. Maps 1110, 1120, 1130, and 1140 show the respective values of a, b, c, and d for each LED 112 of a certain color. One example of thermal response parameters 936 includes maps 1110, 1120, 1130, and 1140 for each one of the X, Y, and Z tristimulus values for each of red LEDs 112, green LEDs 112, and blue LEDs 112. This example of thermal response parameters 936 includes a total of 36 maps.

Each set of four maps 1110, 1120, 1130, and 1140 associated with one color and one of the X, Y, and Z tristimulus values may be determined through least squares fitting by minimizing the expression $$\sum_{i=1}^{MxN}\sum_{i=1}^{Q}\left(y_i^j - a_i T_i^{j^3} - b_i T_i^{j^2} - c_i T_i^j - d_i\right)^2, \quad \text{(Eq. 2)}$$

wherein the index i indicates the i'th LED 112 of an M×N array of LEDs 112 of the color under consideration, the index j indicates the j'th measurement out of a total of Q measurements of a calibration procedure, and $y_i^j$ is the measured stimulus for the j'th measurement of the i'th LED 112, wherein, for each i'th LED 112, $y_i^j$ for all Q measurements is normalized to a common value at a base temperature. The Q measurements include measurements recorded at a variety of different temperatures. The calibration procedure may utilize a colorimeter, or other device known in the art, to measure each $y_i^j$.

Figure 12:
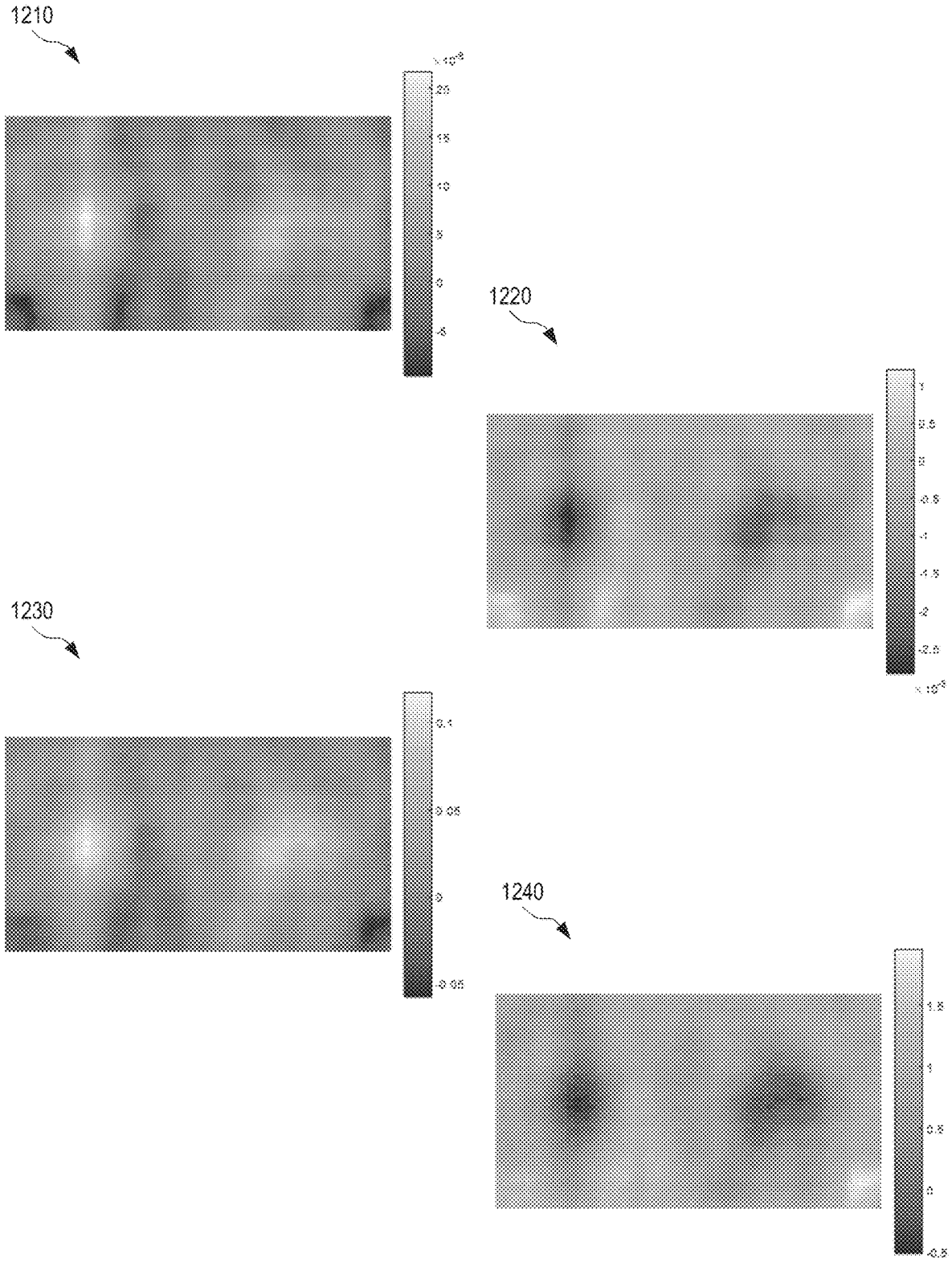
FIG. 12 shows exemplary maps of smoothness-constrained cubic polynomial coefficients for one of the X, Y, and Z tristimulus values for all LEDs of a certain color within an embodiment of the LED array of the display system of FIGS. 1 and 2.

FIG. 12 shows exemplary maps of smoothness-constrained cubic polynomial coefficients (a, b, c, d) for one of the X, Y, and Z tristimulus values for all LEDs 112 of a certain color within an embodiment of LED array 222. In an example, (a, b, c, d) represents ($a_i^y$, $b_i^y$, $c_i^y$, $d_i^y$) for all red LEDs 112 of this embodiment of LED array 222. Maps 1210, 1220, 1230, and 1240 show the respective values of a, b, c, and d for each LED 112 of a certain color. One example of thermal response parameters 936 includes maps 1210, 1220, 1230, and 1240 for each one of the X, Y, and Z tristimulus values for each of red LEDs 112, green LEDs 112, and blue LEDs 112. This example of thermal response parameters 936 includes a total of 36 maps. Maps 1210, 1220, 1230, and 1240 are similar to maps 1110, 1120, 1130, and 1140 except for being subject to a spatial smoothness constraint reducing significant short-scale variation across LED array 222 of the cubic polynomial coefficients associated with a particular color.

Each set of four maps 1210, 1220, 1230, and 1240 associated with one color and one of the X, Y, and Z tristimulus values may be determined through least squares fitting by minimizing the expression $$\sum_{i=1}^{MxN}\sum_{j=1}^{Q}\left(y_i^j - a_i T_i^{j^3} - b_i T_i^{j^2} - c_i T_i^j - d_i\right)^2 + \lambda\nabla(a_i, b_i, c_i, d_i), \quad \text{(Eq. 3)}$$

wherein λ is a weighting factor for the spatial smoothness constraint, and $\nabla(a_i, b_i, c_i, d_i)$ is the sum of differences between the cubic polynomial coefficients for the i'th LED 112 and the respective cubic polynomial coefficients for adjacent LEDs 112 of the same color. A larger value of λ corresponds to a stricter smoothness constraint, resulting in smoother maps for the cubic polynomial coefficients. On the other hand, maps 1110, 1120, 1130, and 1140 are produced with λ equal to zero.

Figure 13:
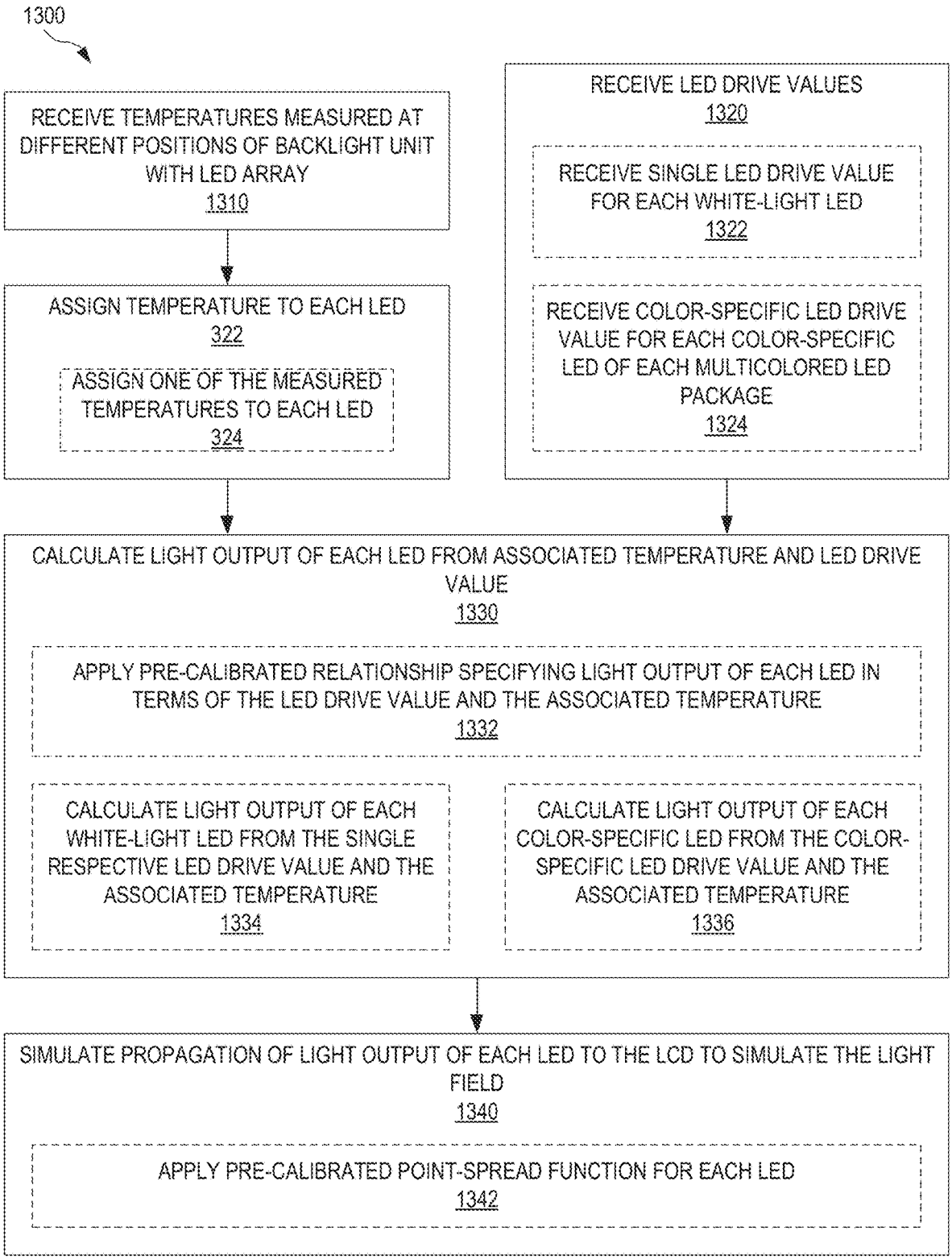
FIG. 13 illustrates a method for simulating the light-field at the LCD of the display system of FIGS. 1 and 2, according to an embodiment.

FIG. 13 illustrates one exemplary method 1300 for simulating light-field 150. Method 1300 is an embodiment of step 320 of method 300 or step 820 of method 800. Method 1300 may be performed by light-field simulator 900.

In a step 1310, method 1300 receives a plurality of temperatures measured at different respective positions of the backlight unit of an LED-backlit LCD system. In one example of step 1310, light-field simulator 900 receives temperatures 232. After step 1310, method 1300 performs step 322, as discussed above in referenced to FIGS. 1 and 2.

In a step 1320, method 1300 receives LED drive values for the LEDs of the backlight unit. In one example of step 1320, light-field simulator 900 receives LED drive values 912, such as LED drive values 712. In one embodiment of step 1320, tailored for use with an embodiment of dual-modulation display system 700 that implements white-light LEDs such as white-light LED packages 500, step 1320 includes a step 1322. Step 1322 receives a single LED drive value for each white-light LED or for each of a plurality of LED zones. In one example, each LED 112 of backlight unit 110 is a white-light LED package 500, and step 1322 receives a single LED drive value 712 for each white-light LED package 500. In another example, each LED 112 of backlight unit 110 is a white-light LED package 500, and step 812 determines a single LED drive value 712 pertaining to all white-light LED packages 500 of each zone 114 of white-light LED packages 500.

Another embodiment of step 1320 is tailored for use with an embodiment of dual-modulation display system 700 that implements color-specific LEDs, wherein different colors are separately adjustable. This embodiment of step 1320 is used with, for example, (a) multicolored LEDs, such as integrated multicolored LED packages 502, or (b) multicolored clusters of LED packages, such as multicolored clusters 504. In this embodiment, step 1320 includes a step 1324. Step 1324 receives a color-specific LED drive value for (a) each color-specific LED of each multicolor LED package, or zone thereof, or (b) each color-specific LED package of each multicolored cluster, or zone thereof. In one example of step 1324, each LED 112 of backlight unit 110 is an integrated multicolored LED package 502, and step 1324 receives a color-specific LED drive value 712 for each color-specific LED 512, 514, and 516, respectively, of each multicolored LED package 502. Alternatively, this example of step 1324 may receive the same color-specific LED drive values 712 for all color-specific LEDs 512, 514, and 516, respectively, within each zone 114. In another example of step 1324, each LED 112 of backlight unit 110 is a multicolored cluster 504 of LED packages 550, and step 1324 receives a color-specific LED drive value 712 for each color-specific LED package 550 of each multicolored cluster 504. Alternatively, this example of step 1324 may receive the same color-specific LED drive values 712 to all color-specific LED packages 550, respectively, within each zone 114.

In a step 1330, method 1300 calculates the light output of each LED based upon the associated temperature determined in step 322 and the associated LED drive value received in step 1320. Step 1330 may be performed by light-field simulator 900.

In an embodiment, step 1330 includes a step 1332 of applying a pre-calibrated function that specifies the light output of each LED in terms of the associated LED drive value and the associated temperature. In one example of step 1332, light-field simulator 900 applies pre-calibrated parameter set 910 to calculate the light output of each LED as discussed above in reference to FIG. 9.

In an embodiment of method 1300, tailored for use with an embodiment of dual-modulation display system 700 that implements white-light LEDs such as white-light LED packages 500, step 1330 includes a step 1334. Step 1334 calculates the light output of each white-light LED from a single respective LED drive value and the temperature associated with the white-light LED. In one example of step 1334, light-field simulator 900 calculates the light output of each of white-light LED packages 500 from (a) a single respective LED drive value 912 (or 712) associated therewith and (b) the temperature 232 associated therewith.

In an embodiment of method 1300, tailored for use with embodiment of dual-modulation display system 700 that implements color-specific LEDs, wherein different colors are separately adjustable, step 1330 includes a step 1336. Step 1336 calculates the light output of each color-specific LED or color-specific LED package from the respective color-specific LED drive value and the temperature associated with the color-specific LED or color-specific LED package. In one example of step 1336, light-field simulator 900 applies tristimulus parameters 930 to calculate the light output of each color-specific LED or color-specific LED package, for example as discussed above in reference to FIG. 9.

A step 1340 simulates the propagation of the light output of each LED, as calculated in step 1330, to the LCD to simulate the light field. In one example of step 1340, light-field simulator 900 applies propagation specification 920 to the light outputs calculated in step 1330, to determine simulated light field 152. Step 1340 may include a step 1342 of applying a pre-calibrated PSF, such as PSF model 922, for each LED.

In certain embodiments, method 1300 is performed repeatedly to aid display of a temperature compensated video or image stream on the LCD of a dual-modulation display system. In such embodiments, steps 1320, 1330, and 1340 may be performed at a higher rate than steps 1310 and 322, since temperature changes generally are much slower than a typical video frame rate, as discussed above in reference to FIG. 3. Alternatively, method 1300 may be applied to a display system that adjusts only LCD drive values while leaving the LED drive values constant, in which case steps 1320, 1330, and 1340 may be performed at the same rate as steps 1310 and 322.

Figure 14:
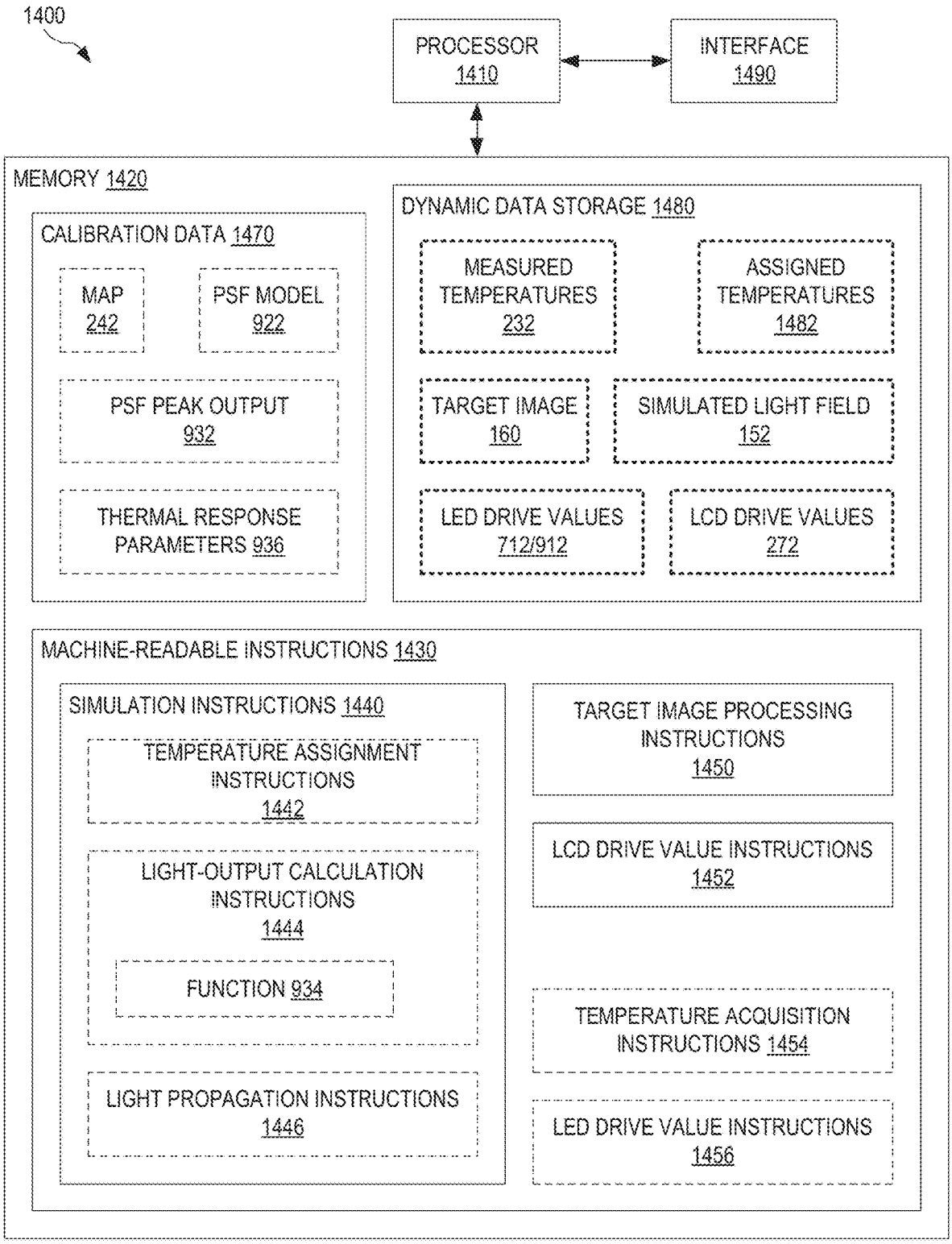
FIG. 14 illustrates a computer that performs temperature compensation for an LED-backlit LCD display, according to an embodiment.

FIG. 14 illustrates one exemplary computer 1400 that performs temperature compensation for an LED-backlit LCD display. One implementation of computer 1400 is an embodiment of light-field simulator 140 and LCD drive solver 170. Another implementation of computer 1400 is an embodiment of light-field simulator 740, LCD drive solver 170, and LED control module 710.

Computer 1400 includes a processor 1410, an interface 1490, and a non-transitory memory 1420. Interface 1490 and memory 1420 are communicatively coupled with processor 1410. Memory 1420 includes machine-readable instructions 1430, calibration data 1470, and dynamic data storage 1480. Machine-readable instructions 1430 and calibration data 1470 may be encoded in a non-volatile portion of memory 1420. Dynamic data storage 1480 is in a volatile portion of memory 1420.

When executed by processor 1410, machine-readable instructions 1430 perform steps 310, 320, 330, 340, and 350 of method 300, or 310, 820, 330, 810, 340, and 350 of method 800. In the performance of step 310, processor 1410 receives measured temperatures 232 via interface 1490 and stores measured temperatures 232 to dynamic data storage 1480. In the performance of step 330, processor 1410 receives target image 160 via interface 1490 and stores target image 160 to dynamic data storage 1480.

Machine-readable instructions 1430 includes simulation instructions 1440 that, upon execution by processor 1410, (a) retrieve measured temperatures 232 from dynamic data storage 1480, (b) perform step 320 of method 300, or step 820 of method 800, to generate simulated light field 152, and (c) store simulated light field 152 to dynamic data storage 1480. Upon execution by processor 1410 and to perform step 320 or step 820, simulation instructions 1440 may invoke calibration data 1470. Simulation instructions 1440 and processor 1410 cooperate to form an embodiment of light-field simulator 140.

Simulation instructions 1440 may include one or more of temperature assignment instructions 1442, light-output calculation instructions 1444, and light propagation instructions 1446. Upon execution by processor 1410, temperature assignment instructions 1442 (a) retrieve measured temperatures 232 from dynamic data storage 1480, (b) perform step 322 of method 300 of 800 to assign a temperature to each LED 112, for example utilizing map 242 retrieved from calibration data 1470, and (c) stores assigned temperatures 1482 to dynamic data storage 1480. Upon execution by processor 1410, light-output calculation instructions 1444 (a) retrieve assigned temperatures 1482, and optionally LED drive values 712 or 912, from dynamic data storage 1480, and (b) perform step 1330 of method 1300 to determine the light output of each LED 112, for example using calibration data 1470. In one implementation, light-output calculation instructions 1444 includes function 934. In this implementation, light-output calculation instructions 1444, upon execution by processor 1410, retrieve PSF peak output 932 and thermal response parameters 936 from calibration data 1470 to perform step 1332 of method 1300. Light propagation instructions 1446, upon execution by processor 1410, (a) perform step 1340 of method 1300 to produce simulated light field 152, and (b) store simulated light field 152 to dynamic data storage 1480. This performance of step 1340 may include retrieving PSF model 922 from calibration data 1470 to perform step 1342.

In one implementation, simulation instructions 1440 include each of temperature assignment instructions 1442, light-output calculation instructions 1444, and light propagation instructions 1446. In this implementation, simulation instructions 1440 and processor 1410 cooperate to form an embodiment of light-field simulator 900.

Machine-readable instructions 1430 further include target image processing instructions 1450 that, upon execution by processor 1410, (a) retrieve simulated light field 152 from dynamic data storage 1480, (b) perform step 340 of method 300 or 800 to generate LCD drive values 272, and (c) store LCD drive values 272 to dynamic data storage 1480. Target image processing instructions cooperate with processor 1410 to form an embodiment of LCD drive solver 170.

Machine-readable instructions 1430 also include LCD drive value instructions 1452 that, upon execution by processor 1410, retrieve LCD drive values 272 from dynamic data storage 1480, and output LCD drive values 272 via interface 1490, so as to perform an embodiment of step 350 of method 300.

In one embodiment, computer 1400 is tailored for use with a dual-modulation LED-backlit LCD. In this embodiment, machine-readable instructions 1430 includes LED drive value instructions 1456 that, when executed by processor 1410, (a) retrieve target image 160 from dynamic data storage 1480, (b) perform step 810 of method 800 to determine LED drive values 712, and (c) store LED drive values 712 to dynamic data storage. LED drive value instructions 1456 cooperate with processor 1410 to form an embodiment of LED control module 710. In this embodiment of computer 1400, simulation instructions 1440 and processor 1410 cooperatively form an embodiment of light-field simulator 740.

In an embodiment, simulation instructions 1440 (optionally without temperature assignment instructions 1442), target image processing instructions 1450, and LCD drive value instructions 1452 are cooperatively configured to, when executed by processor 1410, generate simulated light field 152 at a first rate, for example matching a desired frame rate as discussed above in reference to FIGS. 3 and 9.

Machine-readable instructions 1430 may include temperature acquisition instructions 1454 that, upon execution by processor 1410, control acquisition of measured temperatures 232 at a second rate. This second rate may be slower than the first rate, since temperature changes generally occur on a time scale that is slower than the desired frame rate, as discussed above in reference to FIGS. 3 and 9.

Machine-readable instructions 1430 may form a standalone software product for execution by a third-party processor. In an embodiment, the software product further includes calibration data 1470.

Figure 15:
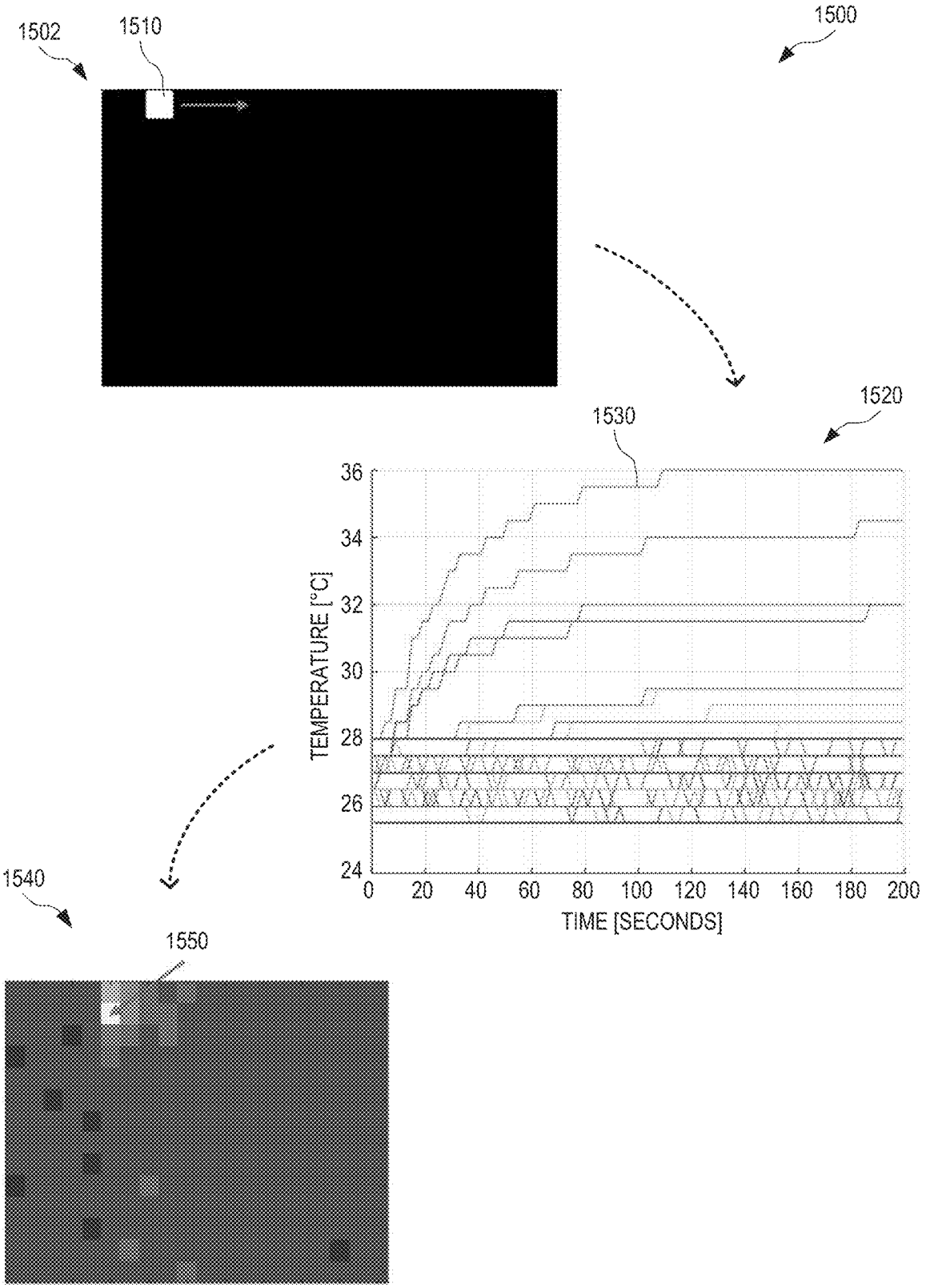
FIG. 15 illustrates a method for determining a map that assigns, to each LED of the display system of FIGS. 1 and 2, a temperature measured by a temperature probe.

FIG. 15 illustrates one exemplary method 1500 for determining map 242. Diagram 1502 shows LED array 222. A group 1510 of LEDs 112 is turned and temperature probes 130 measure temperatures 232 as a function of time as the active operation of LEDs 112 in group 1510 increases the temperature in the area near group 1510. This measurement produces the data shown in plot 1520. Each curve in plot 1520 is generated by a respective temperature probe 130. Curve 1530, recorded by a particular one of temperature probes 130, exhibits the strongest temperature increase. Plot 1540 shows the highest temperature measured by each of temperature probes 130 which, in this example, are arranged in a rectangular array. The highest temperature, indicated by arrow 1550, corresponds to curve 1530. Method 1500 assigns temperature probe 130 indicated by arrow 1550 to all LEDs 112 in group 1510, thereby populating a portion of map 242. Method 1500 repeats this process for a plurality of different groups 1510 until all LEDs 112 have been assigned a temperature probe 130 in map 242.

Changes may be made in the above devices, systems and methods without departing from the scope hereof. It should thus be noted that the matter contained in the above description and shown in the accompanying drawings should be interpreted as illustrative and not in a limiting sense. The following claims are intended to cover generic and specific features described herein, as well as all statements of the scope of the present devices, systems, and methods, which, as a matter of language, might be said to fall there between.

What is claimed is:

1. A display system with temperature compensation, comprising:

a backlight unit including a light emitting diode (LED) array;

a liquid crystal display (LCD) including a plurality of pixels for spatially modulating, according to respective LCD drive values of the pixels, transmission of light generated by the LED array;

a plurality of temperature probes mounted to the backlight unit for measuring a respective plurality of temperatures at the LED array;

a light-field simulator for simulating, at least in part based upon the temperatures and LED drive values for the LED array, a light field at the LCD as generated by the LED array, the light-field simulator including, for each tristimulus value for each LED, a pre-calibrated parameter set specifying the tristimulus value of a light output of the LED as a function of (a) an LED drive value for the LED and (b) an associated temperature derived from the plurality of temperatures, the function being a polynomial function of the LED drive value and a linear function of the associated temperature, the light-field simulator being configured to utilize the pre-calibrated parameter set in said simulating; and an LCD drive solver for processing a target image and the light field simulated by the light-field simulator, to determine the LCD drive values required to display the target image as compensated for temperatures of the LED array.

2. The display system of claim 1, the LED array including a plurality of LEDs exceeding the number of temperature probes.

3. The display system of claim 2, the backlight unit including a circuit board, the LED array being mounted on a side of the circuit board facing the LCD, and the temperature probes being mounted on a side of the circuit board facing away from the LCD.

4. The display system of claim 2, the backlight unit including a circuit board, the LED array and the temperature probes being mounted on a side of the circuit board facing the LCD.

5. The display system of claim 2, the light-field simulator including a map assigning to each LED a temperature measured by one of the temperature probes.

6. The display system of claim 1, further comprising an LED control module for determining the LED drive value for each LED based upon the target image.

7. The display system of claim 6, further comprising an LED driver for driving each LED according to the respective drive value.

8. The display system of claim 1, the polynomial function being a cubic polynomial function.

9. The display system of claim 1, for each tristimulus value for each LED, the function being in form of a lookup table.

10. The display system of claim 1, the LED array including a plurality of multicolored LED packages, each having a plurality of color-specific LEDs for emitting light of different respective colors.

11. The display system of claim 10, the light-field simulator being configured to simulate the light field based upon (a) an LED drive value for each color-specific LED of each multicolored LED package and (b) for each multicolored LED package, an associated temperature derived from the plurality of temperatures.

12. A method for temperature compensation of a light-emitting diode (LED) backlit liquid crystal display (LCD) system, comprising:

receiving a target image;

receiving a plurality of temperatures measured at different respective spatial locations of a backlight unit, the backlit unit including an LED array configured to back-illuminate an LCD;

simulating, at least partly based upon the temperatures and LED drive values for the LED array, a light field at the LCD as generated by the LED array, said simulating including utilizing, for each tristimulus value for each LED of the LED array, a pre-calibrated parameter set specifying the tristimulus value of a light output of the LED as a function of (a) an LED drive value for the LED and (b) an associated temperature derived from the plurality of temperatures, the function being a polynomial function of the LED drive value and a linear function of the associated temperature;

processing the target image and the light field generated by said simulating, to determine LCD drive values of pixels of the LCD required to display the target image as compensated for temperatures of the LED array; and sending the LCD drive values to an LCD controller configured to control the pixels.

* * * * *